United States Patent [19]

Lina et al.

[11] Patent Number: 4,986,453

[45] Date of Patent: Jan. 22, 1991

[54] ATOMIZING PUMP

[75] Inventors: Jean-Pierre Lina, Le Neubourg; Hervé Pennaneach, Verneuil sur Avre, both of France; Efrem M. Ostrowsky, Highland Park; David G. Moore, Algonguin, both of Ill.

[73] Assignee: The Pittway Corporation, Northbrook, Ill.

[21] Appl. No.: 352,778

[22] Filed: May 16, 1989

Related U.S. Application Data

[63] Continuation-in-part of Ser. No. 351,953, May 15, 1989.

[51] Int. Cl.[5] ..... B65D 88/54

[52] U.S. Cl. ..... 222/321; 222/383; 239/333

[58] Field of Search ..... 222/321, 385, 383, 309, 222/384; 239/333, 321, 350, 354; 417/549, 547

[56] References Cited

U.S. PATENT DOCUMENTS

| | | | |
|---|---|---|---|
| Re. 28,366 | 3/1975 | Pechstein | 222/383 |
| 2,534,504 | 12/1950 | Engstrom | 222/383 |
| 2,657,834 | 11/1953 | Bacheller | 222/321 |
| 3,124,080 | 3/1964 | Sisson | 103/178 |
| 3,159,316 | 12/1964 | O'Donnell et al. | 222/321 |
| 3,187,960 | 6/1965 | Gorman | 222/321 |
| 3,211,346 | 10/1965 | Meshberg | 222/263 |
| 3,223,292 | 12/1965 | Keeney et al. | 222/321 |
| 3,228,570 | 1/1966 | Steiman | 222/321 |
| 3,228,571 | 1/1966 | O'Donnell et al. | 222/321 |
| 3,229,864 | 1/1966 | Roder | 222/321 |
| 3,237,571 | 3/1966 | Corsette | 222/321 |
| 3,239,151 | 3/1966 | Boris | 239/333 |
| 3,257,961 | 6/1966 | Schlenker | 103/178 |
| 3,331,559 | 7/1967 | Fedit | 239/333 |
| 3,399,836 | 9/1968 | Pechstein | 222/321 |
| 3,414,169 | 12/1968 | Corsette | 222/321 |
| 3,458,090 | 7/1969 | Scoggin, Jr. | 222/309 |
| 3,463,093 | 8/1969 | Pfeiffer et al. | 103/188 |
| 3,583,605 | 6/1971 | Corsette | 222/321 |
| 3,608,788 | 9/1971 | Tanaka | 222/384 |
| 3,627,206 | 12/1971 | Boris | 222/321 |
| 3,680,790 | 8/1972 | Boris | 239/353 |
| 3,746,260 | 7/1973 | Boris | 222/321 |
| 3,756,474 | 9/1973 | Riccio | 222/193 |
| 3,761,022 | 9/1973 | Kondo | 239/333 |
| 3,774,849 | 11/1973 | Boris | 239/338 |
| 3,796,375 | 3/1974 | Boris | 239/333 |
| 3,799,448 | 3/1974 | Nozawa et al. | 239/321 |
| 3,877,616 | 4/1975 | Stevens | 222/321 |
| 3,908,870 | 9/1975 | Nozawa et al. | 222/321 |

(List continued on next page.)

FOREIGN PATENT DOCUMENTS

| | | |
|---|---|---|
| 0289854 | 4/1988 | European Pat. Off. . |
| 0289855 | 4/1988 | European Pat. Off. . |
| 0289856 | 4/1988 | European Pat. Off. . |
| 2133259 | 11/1972 | France . |
| 2285815 | 4/1976 | France . |
| 2433982 | 3/1980 | France . |
| 2558214 | 7/1985 | France . |
| 2249716 | 6/1989 | France . |

OTHER PUBLICATIONS

Catalog entitled Bakan Plastics Non-Aerosol Sprayers and Dispensers.

*Primary Examiner*—H. Grant Skaggs
*Assistant Examiner*—Kenneth Noland
*Attorney, Agent, or Firm*—Dressler, Goldsmith, Shore, Sutker & Milnamow, Ltd.

[57] ABSTRACT

A finger-operated pump is provided with a pump chamber and a fixed supply conduit communicating with the pump chamber. A movable sealing conduit is adapted to slidably and sealingly engage the supply conduit in a telescoping relationship. A primary piston is operably disposed in the chamber and defines a discharge passage out of the pump chamber. A poppet having a primary valve means for occluding the discharge passage is biased against the primary piston by a spring. The poppet has a secondary valve means for occluding flow through the sealing conduit that engages the poppet through a lost motion arrangement which is defined in part by the spring and which permits a limited degree of relative movement between the poppet and the sealing conduit.

56 Claims, 6 Drawing Sheets

U.S. PATENT DOCUMENTS

| | | | |
|---|---|---|---|
| 3,923,250 | 12/1975 | Boris | 239/321 |
| 3,940,028 | 2/1976 | Beard | 222/321 |
| 3,949,906 | 4/1976 | Pettersen et al. | 222/153 |
| 3,949,910 | 4/1976 | Focht | 222/321 |
| 3,991,914 | 11/1976 | Kotuby et al. | 222/321 |
| 4,022,354 | 5/1977 | Kotuby | 222/321 |
| 4,025,046 | 5/1977 | Boris | 239/333 |
| 4,050,613 | 9/1977 | Corsette | 222/321 |
| 4,050,860 | 9/1977 | Beres | 417/444 |
| 4,051,983 | 10/1977 | Anderson | 222/333 |
| 4,056,216 | 11/1977 | Kotuby | 222/385 |
| 4,061,247 | 12/1977 | Meshberg | 222/1 |
| 4,089,442 | 5/1978 | Hafele et al. | 222/321 |
| 4,144,987 | 3/1979 | Kishi | 222/321 |
| 4,147,476 | 4/1979 | Warren | 417/328 |
| 4,154,374 | 5/1979 | Kirk, Jr. | 222/321 |
| 4,189,064 | 2/1980 | O'Neill et al. | |
| 4,230,242 | 10/1980 | Meshberg | 239/321 |
| 4,274,560 | 6/1981 | Cater | 222/321 |
| 4,402,432 | 9/1983 | Corsette | 222/321 |
| 4,606,479 | 8/1986 | Van Brocklin | 222/385 |
| 4,821,928 | 4/1989 | Su | 239/333 |
| 4,830,284 | 5/1989 | Maerte | 222/321 |

ATOMIZING PUMP

This is a continuation-in-part of application Ser. No. 07/351,953, entitled "POMPE-DOSEUSE PERFECTIONNEE POUR PULVERISATEURS" (and listed in English as "IMPROVED DISPENSING PUMP FOR SPRAYING" in the inventors' declarations) and filed by Jean-Pierre Lina and Herve Pennaneach on May 15, 1989 still pending.

TECHNICAL FIELD

This invention relates to liquid dispensers or pumps. The present invention is particularly well-suited for use as a small, hand-held, finger-operated pump disposed on the top of a container of liquid for dispensing the liquid in a desired form, such as in an atomized spray or foam, from a nozzle communicating with the top of the pump.

BACKGROUND OF THE INVENTION AND TECHNICAL PROBLEMS POSED BY THE PRIOR ART

Finger-operated pumps are conventionally employed with a suitable nozzle structure as part of a closure at the top of a liquid product container, such as a metal can, glass bottle, or plastic bottle. Depending upon the nozzle structure, the liquid may be discharged as a jet stream, a spray, an atomized fine spray, a foam, or other suitable form. Such pumps may be used to dispense a wide variety of liquid products such as cleaners, hair styling preparations, perfumes, deodorants, throat sprays, air fresheners, lotions, and the like.

U.S. Pat. No. 4,025,046 issued to Michel Boris discloses a number of prior art designs for finger-operated dispensing pumps. One design includes a pump chamber with an internally disposed, upwardly projecting, supply conduit having an open upper end and having a lower end connected at the bottom of the chamber to a suction tube extending down into the container of liquid.

A piston is slidably disposed in the pump chamber and includes a piston rod extending upwardly out of the top of the pump chamber to the nozzle. A discharge passageway is defined in the piston and rod to provide communication between the pump chamber and the nozzle.

A poppet is provided with a valve member to seal against a valve seat on the piston, and the poppet is normally biased against the piston by a spring so as to occlude flow through the discharge passage to the nozzle. The poppet also has an outer pressure-bearing surface exposed in the pump chamber at all times. A generally cylindrical sleeve extends downwardly from the poppet and is spaced above the supply conduit when the pump is in the inactive position.

When the piston is displaced downwardly in the pump chamber, as by pushing down on the top of the nozzle, the poppet is pushed against the spring and the poppet sleeve telescopically slides down over the suction conduit open upper end to seal around the suction conduit. The pressure of the liquid and residual gas within the pump chamber then increases as the piston is pushed down further. The increasing pressure acting upwardly on the piston is opposed by the finger force exerted downwardly on the piston, and the increasing pressure acting downwardly on the poppet pressure-bearing surface produces a force acting through the poppet against the spring. When this pressure increases sufficiently to overcome the spring force, the poppet moves further downwardly in the pump chamber, still sealing against the supply conduit, so that the poppet valve member moves away from the piston thereby opening the discharge passage and permitting the pressurized liquid to escape through the nozzle while being atomized.

In other proposed designs for dispensing pumps, a secondary piston is continuously engaged with a supply conduit, and a gravity-biased check valve is interposed between the pump chamber and the supply conduit to accommodate a refilling of the pump chamber. In most such designs, the check valve tends to undesirably move away from the seat when the pump is inverted if the pump chamber is not under sufficient pressure. If this occurs during the operation of the pump, the pump may malfunction or may not function as well as when the pump is in a generally upright orientation.

After the above-described pumps are operated to discharge the liquid by initially pushing the nozzle and connected piston downwardly, the finger force is typically removed or greatly reduced so as to permit the spring to urge the poppet back up against the piston and to continue urging the poppet, along with the engaged piston and nozzle, upwardly to the fully raised position (i.e., the initial, inactive "rest" position). As this occurs, liquid from the container is drawn up into the pump chamber.

The rate of refilling of the pump chamber with liquid from the container, and the amount of liquid that can be held in the pump chamber, depend upon the nature of the pump chamber and the pump features provided for accommodating the refilling flow of liquid. In some applications, it would be desirable to provide a relatively large amount of pump chamber capacity, and it would be desirable to refill the pump chamber as quickly and as fully as possible.

Another problem that must be overcome is the priming of the pump, especially where the pump chamber has a relatively large volume. Air and/or liquid vapor that is initially present in the pump chamber is compressed on the downward stroke of the piston. Owing to the high compressibility of the air, the resulting pressure is usually not great enough to move the poppet away from the piston to permit the discharge of the air out through the nozzle with a concomitant reduction in chamber pressure. Consequently, little or no liquid is drawn into the pump chamber during the return stroke of the piston, and the entrapped air merely expands to occupy the increasing volume of the pump chamber.

Various mechanisms have been proposed for venting air from the pump chamber to facilitate priming of the pump chamber with the liquid from the container. For example, the U.S. Pat. No. 3,774,849 issued to Michel Boris discloses the use of long vent ridges on the inner wall of a lower portion of the pump chamber This permits the compressed air to vent upwardly around the piston at the bottom of the piston stroke and to then flow into the container through an aperture in the upper part of the pump chamber. While this generally works well with the particular pump structure for which it was designed, it would be desirable to provide an improved structure for facilitating the air venting and liquid priming of a pump chamber, particularly a pump chamber having an increased capacity and increased liquid refill or priming flow rates.

It would also be beneficial if a pump having the above-described improved features could be provided with a configuration which, when the pump is in the unactuated position, has a reduced number of components that are in sealing engagement. Continuous engagement of seal parts over a long period of time can cause soft seal part material to creep and permanently deform. This can lead to reduced effectiveness of the sealing function between the engaged components.

In many applications, it is desired to produce a very highly atomized, fine mist. A problem with some pump designs is that the desired fine mist will be dispensed only if the operator pushes down the nozzle actuator with sufficient force and speed. Otherwise, liquid droplets may dribble out of the nozzle rather than the liquid being atomized in a fine mist—especially at the beginning and end of the liquid discharge. Thus, it would be desirable to provide an improved, finger-actuated pump for dispensing the liquid in a fine mist regardless of how slowly or discontinuously the nozzle actuator is pushed down by the user.

It would also be advantageous if an improved, finger-operated pump could be provided with a minimum number of small components that could be relatively quickly and easily assembled so as to facilitate fabrication of the pump.

Finally, it would be desirable to provide such an improved pump in which the configurations of the components could be simplified so as to facilitate fabrication of the components, as well as assembly of the components.

SUMMARY OF THE INVENTION

The present invention provides an improved, finger-operated pump. The pump includes a pump chamber and supply conduit communicating with the pump chamber. A movable sealing conduit is provided for slidably and sealably engaging the supply conduit in a telescoping relationship.

A primary piston is operably disposed in the pump chamber and defines a discharge passage out of the pump chamber.

A poppet is provided with a primary valve means for occluding the discharge passage. The poppet also has a secondary valve means for occluding flow through the top of the movable sealing conduit.

A lost motion means is provided for permitting a limited degree of relative movement between the poppet and the sealing conduit between first and second extremes of the relative movement.

In the preferred embodiment, the lost motion means includes a spring means for (1) engaging the poppet and sealing conduit at least when the poppet and sealing conduit are at the first extreme, and (2) biasing the poppet primary valve means against the primary piston.

The present invention may be alternatively characterized as including (1) a biasing means, such as a spring, for biasing the poppet primary valve means against the primary piston and (2) a lost motion means for permitting the limited degree of relative movement between the poppet and sealing conduit between first and second extremes of the relative movement—the lost motion means including a portion of the biasing means that is located to engage the poppet and sealing conduit at the first extreme of relative movement In the preferred embodiment, the biasing means or spring means includes a single spring which is operatively disposed to engage the poppet and not the sealing conduit when the poppet and sealing conduit are at the second extreme of the relative movement. At the second extreme of relative movement, a portion of the poppet and a portion of the sealing conduit become engaged and, when engaged, fulfill two functions: (1) occluding flow through the sealing conduit, and (2) defining a part of the lost motion means which limits the relative movement at the second extreme of the relative movement.

With this invention, the pump can be designed so that the poppet secondary valve means can seal against the top of the sealing conduit during the pressurizing stroke of the primary piston when sealing conduit and poppet are oriented at one of the extremes of relative movement. As the primary piston starts to rise to the fully elevated rest position on the return stroke, the secondary valve means and sealing conduit separate, owing to the lost motion arrangement, and the sealing conduit and poppet are maintained at the other extreme of the relative movement for the remainder of the upward stroke aided by the frictional resistance of the sealing conduit with the supply conduit. This permits air to be vented down the suction tube into the container, and this also permits liquid to flow out of the container through the sealing conduit for refilling the pump chamber.

The novel lost motion arrangement permits, if desired, the advantageous use of a pump design in which the sealing conduit is completely disengaged from the supply conduit when the pump is in the inactive, "rest" position. This provides an additional flow path for the liquid when refilling the pump chamber. This also prevents the sealing parts of the supply conduit and sealing conduit from taking on a permanent deformation or set which would have a deleterious effect on the sealing function.

The use of a spring which, in the preferred embodiment, functions as both (1) a biasing means for biasing the poppet to close the discharge passage and (2) a part of the lost motion means, has the advantage of providing a lost motion structure which is easily fabricated and assembled.

It has been found that the novel, improved pump of the present invention can operate at relatively large capacities and at relatively high refill flow rates. When employed with an appropriate nozzle structure, the improved pump of the present invention operates to produce a fine mist with little or no dribble or sputtering. With other appropriate nozzles, suitable liquids may be dispensed as a lotion, stream, foam or the like.

Further, since the pump of the present invention does not have a gravity-biased check valve or gravity-biased back flow-preventing valve, operation of the pump in an inverted position during a continuous pressurizing portion of the piston stroke does not result in an undesired communication between the pump chamber and the liquid container.

Numerous other features and advantages of the present invention will become apparent from the following detailed description taken in conjunction with the accompanying drawings.

BRIEF DESCRIPTION OF THE DRAWINGS

A preferred embodiment of the invention will next be described, by way of example only, with reference to the accompanying drawings, in which.

DETAILED DESCRIPTION OF THE PREFERRED EMBODIMENT

While this invention is susceptible of embodiment in many different forms, this specification and the accompanying drawings disclose only one specific form as an example of the use of the invention. The invention is not intended to be limited to the embodiment so described, and the scope of the invention will be pointed out in the appended claims.

For ease of description, the apparatus of this invention is described in the normal (upright) operating position, and terms such as upper, lower, horizontal, etc., are used with reference to this position. It will be understood, however, that the apparatus of this invention may be manufactured, stored, transported, and sold in an orientation other than the position described.

Some of the figures illustrating the preferred embodiment of the apparatus show structural details and mechanical elements that will be recognized by one skilled in the art. However, the detailed descriptions of such elements are not necessary to an understanding of the invention, and accordingly, are not herein presented.

DESCRIPTION OF THE COMPONENTS AND OF THE ARRANGEMENT OF THE COMPONENTS

Figure 1:
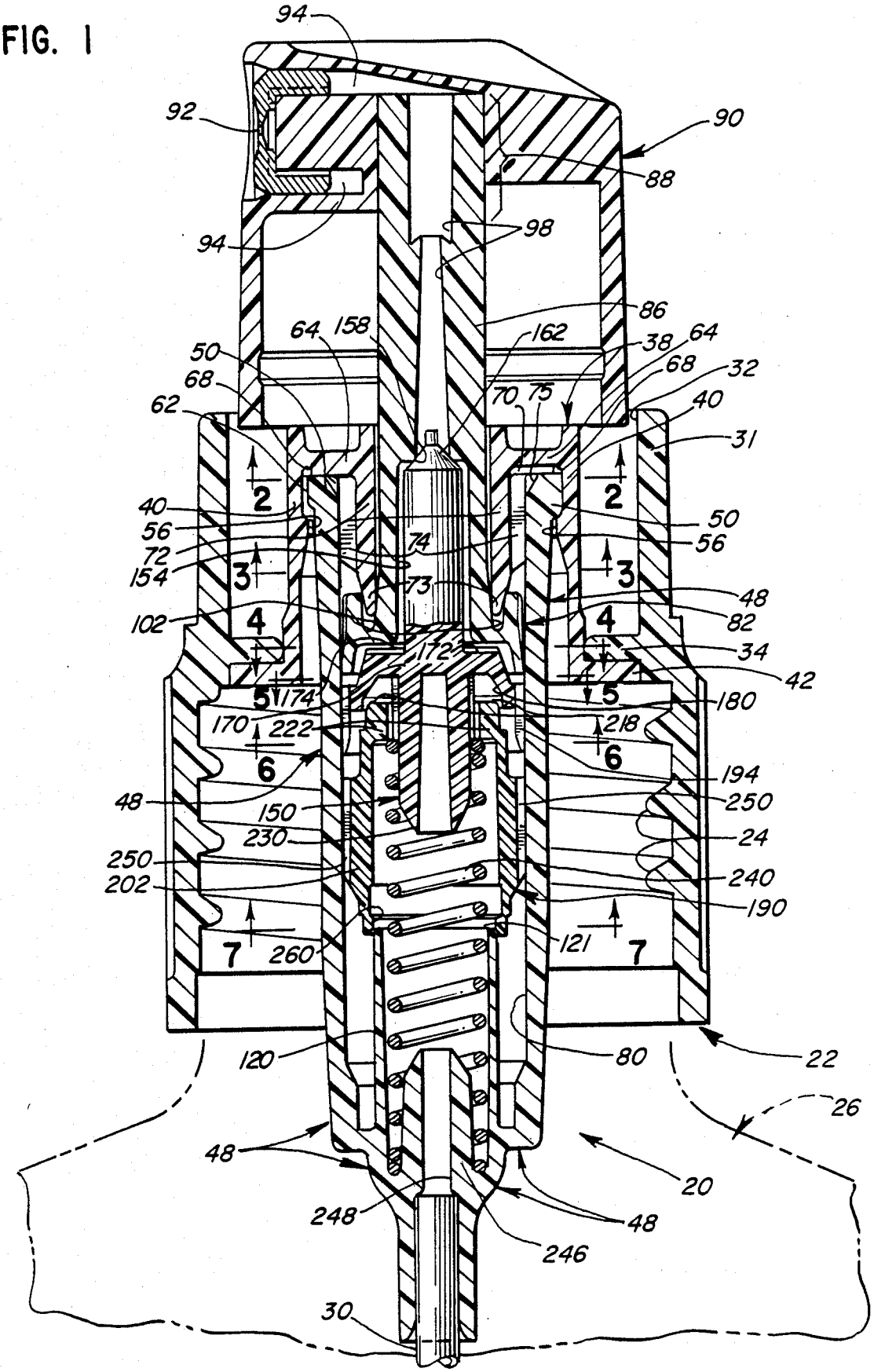
FIG. 1 is an elevational view, partly in cross-section, of the finger-operated pump of the present invention shown connected with a fragmentary portion of a suction tube and shown mounted in a closure cap on the top of a container that is illustrated in phantom by dashed lines.

With reference to FIG. 1, the pump of the present invention is designated generally by the reference numeral 20. The pump 20 is mounted within a conventional closure cap 22 which includes suitable means, such as threads 24, for attaching the cap 22, along with the pump 20 mounted therein, to the open top of a conventional container 26.

The container 26 is loaded with a liquid product (not visible below the pump 20 in the container 26 illustrated in FIG. 1). The liquid is drawn up into the pump 20 through a conventional suction tube or dip tube 30 which is connected by suitable conventional means to the bottom of the pump 20. The suction tube 30 extends to near the bottom of the container 26. The bottom end of the suction tube 30 is thus normally submerged in the liquid when the container 26 is in a generally upright orientation as illustrated in FIG. 1.

The cap 22 has a generally cylindrical, hollow wall 31 defining an interior cylindrical opening 32 above, and separated from, the threads 24 by an inwardly projecting annular flange 34. Mounted within the cap opening 32 is a collar 38 which has an outer wall 40 defining an outwardly projecting annular flange 42 on its lower end. The collar flange 42 is retained by the cap flange 34 tight against the top of the mouth of the container 26.

The collar 38 is adapted to engage and retain the pump 20 within the cap 22. To this end, the pump 20 includes a housing 48 with an outwardly projecting flange 50 at its upper end. The flange 50 is engaged by a radially inwardly projecting ring 56 on the outer wall 40 of the collar 38. The collar 38 can be easily snap-fit onto the pump housing 48 to effect this engagement.

The pump housing 48 defines an internal pump chamber 80. In the preferred embodiment, the pump chamber 80 is a generally cylindrical cavity with an open top in which is received an inner cylindrical wall 72 of the collar 38. The wall 72 is connected to the collar outer wall 40 via an annular top wall 64. The inner wall 72 terminates with a tapered bottom end 73 inside the pump chamber 48.

Figure 2:
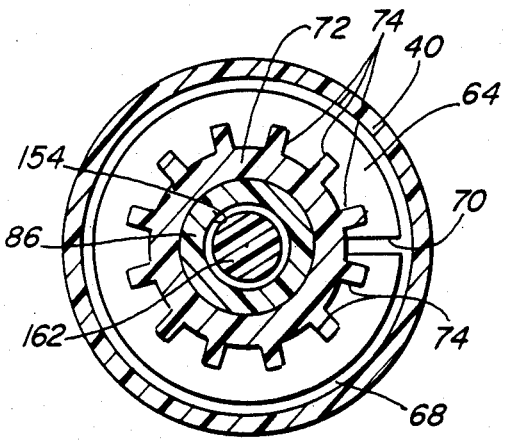
FIG. 2 is a cross-sectional view taken generally along the plane 2—2 in FIG. 1 (looking up)
Figure 3:
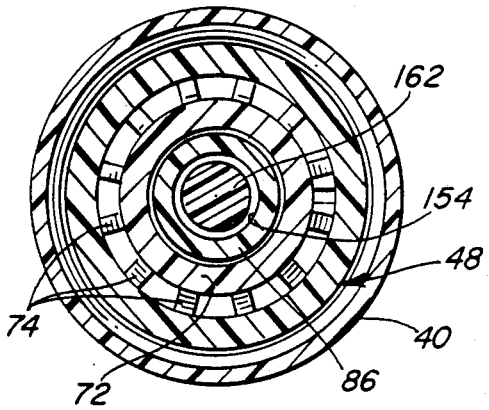
FIG. 3 is a cross-sectional view taken generally along the plane 3—3 in FIG. 1 (looking up)
Figure 8:
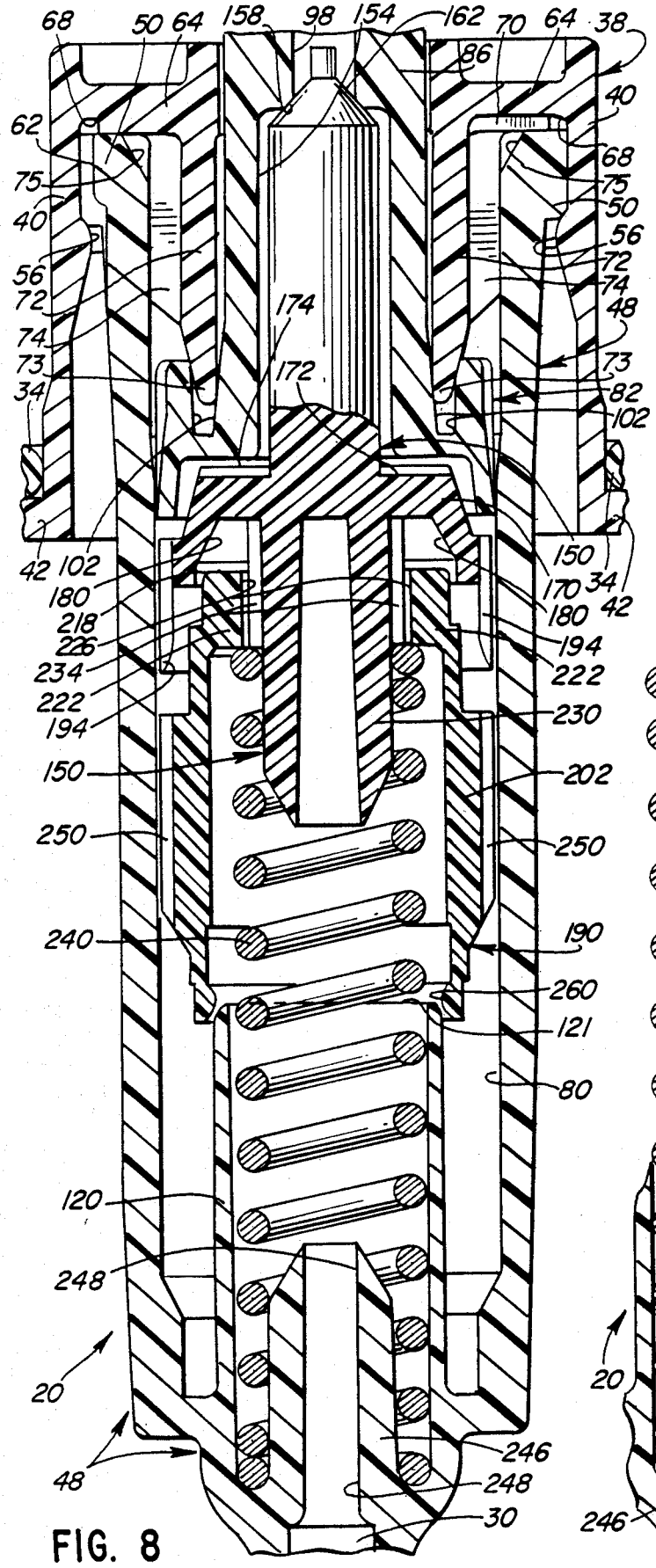
FIG. 8 is an enlarged view of the pump with the components in the position illustrated in FIG. 1.

The flange 50 at the upper end of the pump housing 48 has a vertical notch 62 (visible in the left-hand side of FIG. 1) to provide an air venting gap between the pump housing 48 and the collar outer wall 40 for cooperating with certain vent passages in the collar 38. In particular, the collar annular top wall 64 defines a circumferential groove 68 in its underside. The groove 68 communicates with the top of the notch 62 (FIG. 1). At a position 180 degrees from the notch 62, the groove 68 communicates with a radial groove 70 defined in the underside of the collar top wall 64 (FIGS. 2 and 8). As best illustrated in FIG. 8, the groove 70 extends inwardly beyond the wall of the pump housing 48.

The collar inner cylindrical wall 72 has a plurality of circumferentially spaced, outwardly projecting ribs 74 (FIGS. 2 and 8). The outer vertical surfaces of the ribs 74 engage the inner surface of the wall of the pump housing 48 and function to generally align the collar 38 and the pump housing 48 in a coaxial relationship.

The entire circumference of the inner top edge of the pump housing 48 is chamfered at 75 to define an annular passage around the collar 38 at the tops of the ribs 74. The ribs 74 function to define spaces between the ribs to permit the annular region below the ribs 74 at the bottom of the collar inner cylindrical wall 72 to communicate with the annular passage around the tops of the ribs 74. This establishes an air vent path from the interior of the pump housing 48 that continues outwardly through radial groove 70, around circumferential groove 68, through notch 62, past collar ring 56, and then down between the collar outer cylindrical wall 40 and the pump housing 48 into the interior head space of the container 26 above the liquid. This air vent path functions, in conjunction with other pump components, to vent atmospheric air into the container 26 as described in detail hereinafter.

As best illustrated in FIG. 1, primary piston 82 is sealingly and slidably disposed for reciprocation in the pump chamber 80. The primary piston 82 includes an upwardly extending rod or stem portion 86 which projects out of the pump chamber 80 past the collar 38 and above the cap 22. The rod or stem 86 has an upper cylindrical portion 88 adapted to accept an actuator and nozzle discharge head or button 90. The illustrated discharge head 90 is of the conventional spray type having an associated spray orifice 92 communicating through suitable passages 94 with the top end of the primary piston stem 86. The primary piston 82, including the upwardly projecting stem 86, is hollow and defines a discharge passage 98 establishing communication between the nozzle passages 94 and the pump chamber 80.

The exterior of the primary piston end 86 is tapered so that the diameter of the stem 86 decreases with increasing height from the collar 38. An annular clearance always exists around the stem 86 and the top of the collar 38 for permitting air to vent down along the stem 86 toward the bottom of the piston 82. The bottom end of the primary piston 82 defines an upwardly concave sealing surface 102 for receiving and sealing against each side surface of the collar inner wall bottom end 73 when the primary piston 82 is in the fully raised, "rest" position illustrated in FIGS. 1 and 8.

Figure 9:
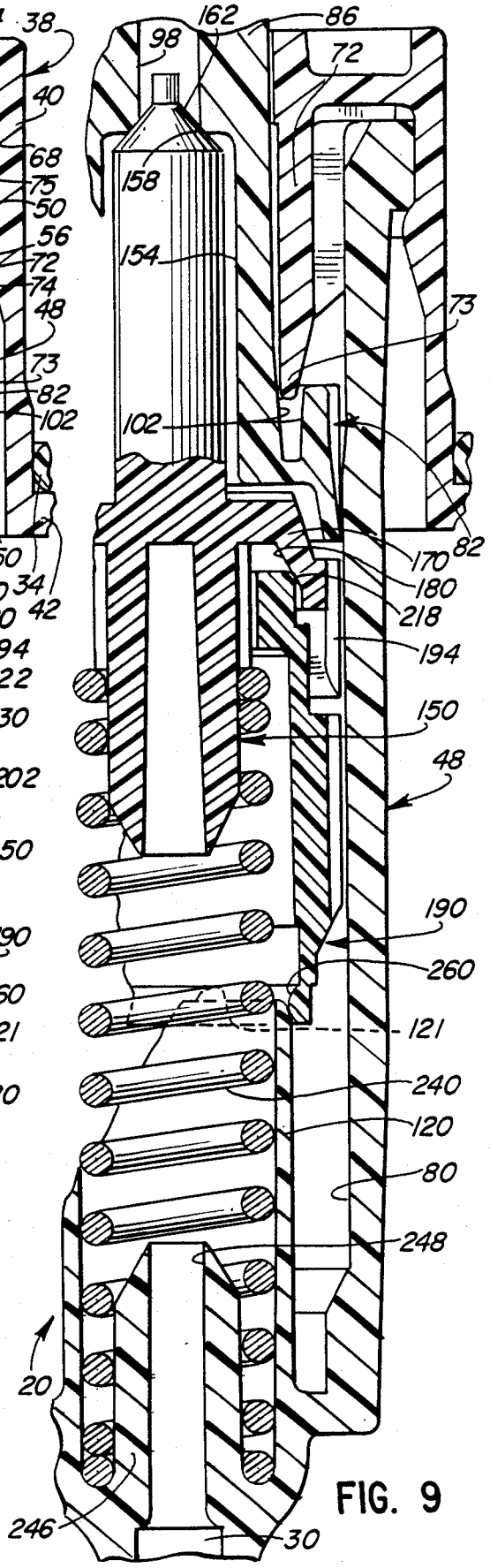
FIGS. 9, 10, 11, 11A, 12, and 13 are views similar to FIG. 8, but show sequentially moved positions of the pump components to illustrate the sequence of the operation of the pump.
Figure 13:
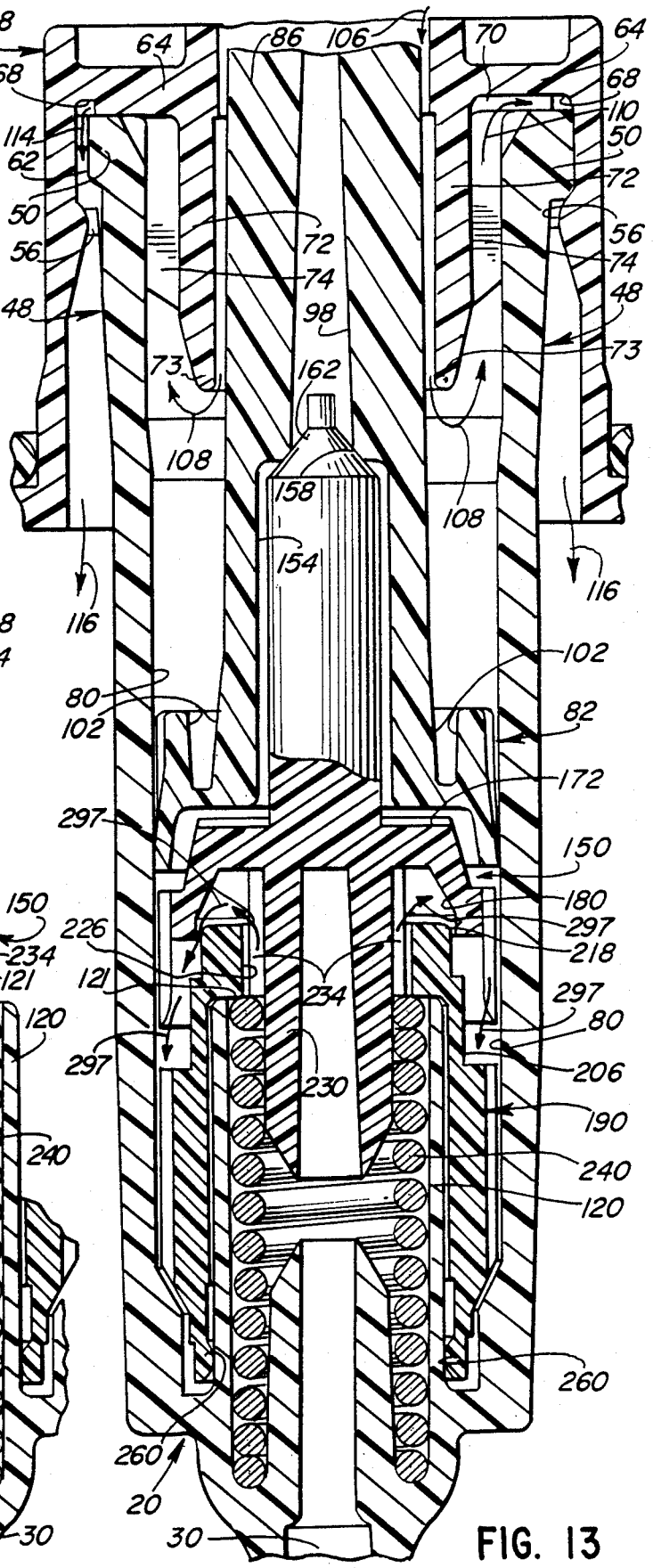

However, as best illustrated in FIGS. 9 and 13, whenever the primary piston 82 is partially or substantially fully depressed, the piston concave sealing surface 102 moves out of sealing engagement with respect to the collar inner wall bottom end 73. Clearance is established between the exterior of the reduced diameter upper portion of the downwardly moving primary piston stem 86 and the collar inner wall bottom end 73. This permits the ambient atmosphere to flow into the container 26 to replace the volume of the discharged contents and maintain atmospheric air pressure within the container 26. Specifically, with reference to FIG. 1, it can be seen that ambient air can flow from outside the cap 22, over the cap top into the cap opening 32, and then up under the hollow discharge head, or button 90.

With reference to FIG. 13, it can be seen that when the stem 86 is in a lowered position, the air from under the actuator button 90 flows down along the path illustrated by the flow arrows 106 between the collar 38 and the stem 86. As illustrated by the flow arrows 108 in FIG. 13, the air then flows upwardly between the collar inner cylindrical wall 72 and the pump housing 48. As illustrated in FIG. 13 by the flow arrow 110, the air then flows through the radial groove 70 to the circumferential groove 68 (see also FIG. 2). The air flows through the circumferential groove 68 in both directions around the circumference of the collar 38 for about 180 degrees where it then flows through the pump housing notch 62 as illustrated by the flow arrow 114 in FIG. 13. The air continues flowing downwardly between the collar 38 and pump housing 48 and then into the top of the container 26 as indicated by the flow arrows 116 in FIG. 13.

The pump 20 is constructed to admit liquid into the pump chamber 80 from the supply tube 30 through a fixed supply conduit which, in the preferred illustrated embodiment, includes a cylindrical tube 120 that projects upwardly inside the pump chamber 80 and that terminates in an open upper end 121.

A poppet 150 is axially aligned above the fixed supply conduit or tube 120 and is adapted to move with, as well as relative to, the primary piston 82 above the fixed supply conduit 120. In particular, the poppet 150 has a primary valve means for occluding flow through the primary piston discharge passage 98. To this end, the primary piston 82 includes an enlarged bore 154 (FIGS. 2 and 8), the upper end of which opens to the smaller diameter discharge passage 98 at a port defined by an annular valve seat 158.

The poppet 150 has an upwardly extending primary valve member or means 162 (FIGS. 2 and 8) for sealing against the annular valve seat 158 in the primary piston 82 so as to occlude upward flow of liquid from the pump chamber 80 through the discharge passage 98.

Figure 4:
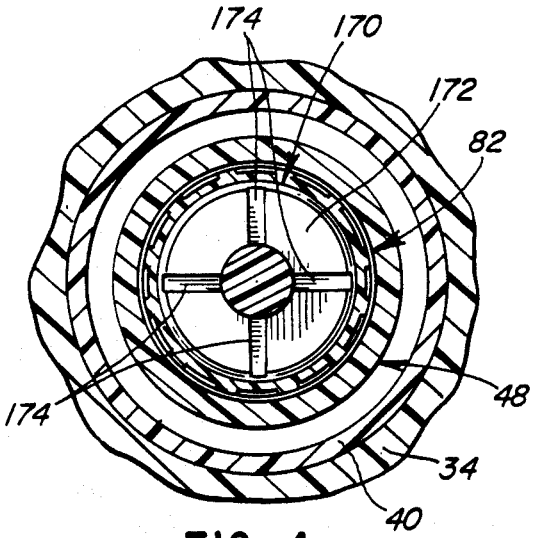
FIG. 4 is a cross-sectional view taken generally along the plane 4—4 in FIG. 1 (looking down)

The poppet 150 includes a lower portion with a flange 170 (FIGS. 5 and 8) and a downwardly projecting pin 230. As best illustrated in FIGS. 4 and 8, the flange 170 has an upper piston surface 172 with four, outwardly radiating ribs 174 projecting above the surface 172. The upwardly facing surface 172 functions as a piston surface for being pressurized by the liquid in the pump chamber 80 under conditions explained in detail hereinafter.

Figure 5:
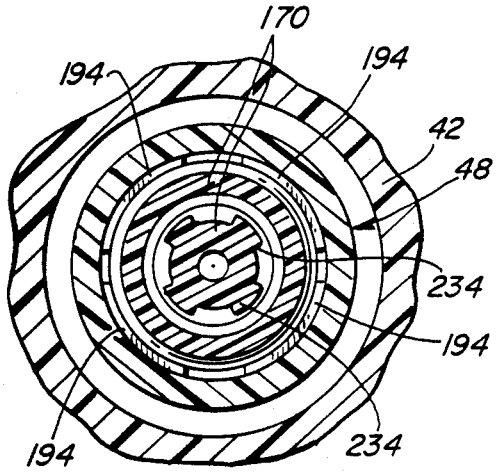
FIG. 5 is a cross-sectional view taken generally along the plane 5—5 in FIG. 1 (looking down)
Figure 6:
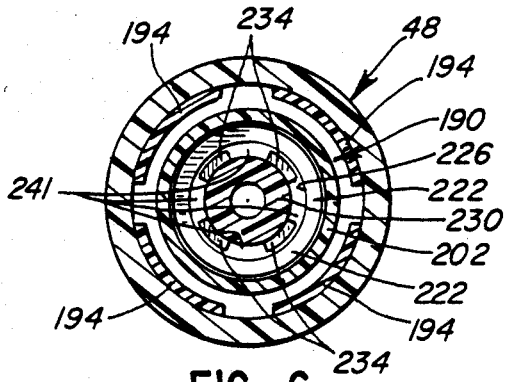
FIG. 6 is a cross-sectional view taken generally along the plane 6—6 in FIG. 1 (looking up)
Figure 7:
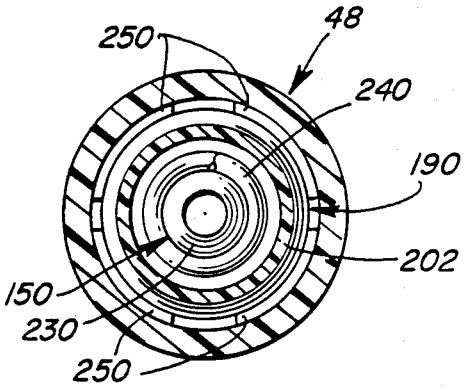
FIG. 7 is a cross-sectional view taken generally along the plane 7—7 in FIG. 1 (looking up)

The poppet flange 170 also includes a plurality of circumferentially spaced-apart guide ribs or fingers 194 (FIGS. 5, 6, and 8). As best illustrated in FIG. 8, the exterior of each rib or finger 194 is adapted to slidably engage the wall of the pump chamber 80 and guide the axial movement of the poppet 150.

The pin 230 projecting downwardly at the bottom of the poppet 150 includes four, circumferentially space-apart ribs 234 (FIGS. 5, 6, and 8). The ribs 234 define circumferentially spaced-apart, vertical, grooves 241 (FIG. 6 only). The bottoms of the ribs 234 are adapted to be engaged by the upper end of a biasing means or spring means, such as a helical coil compression spring 240 (FIG. 8).

The spring 240 is mounted within the pump chamber 80, and the bottom end of the spring 240 is received inside the fixed supply conduit 120. The bottom end of the spring 240 is maintained in axial alignment by an inner conduit 246 which projects upwardly inside the supply conduit 120 and which defines an inlet passage 248 communicating between the supply tube 30 and the supply conduit 120. The upper end of the spring 240 is maintained in axial alignment by the pin 230 extending downwardly from the poppet 150.

The underside of the poppet flange 170 functions as a secondary valve means, and in particular, defines a concave valve member surface 180 for sealing against the top of a movable sealing means or sealing conduit 190 that is engageable with the poppet 150 through a lost motion structure, described hereinafter, which permits relative movement between the poppet 150 and sealing conduit 190.

To this end, the sealing conduit 190, in the preferred form illustrated, has a generally cylindrical configuration that includes a generally cylindrical, hollow, lower wall 202 and an upper cross wall 222.

The upper cross wall 222 of the sealing conduit 190 defines therein an aperture 226 (FIGS. 6 and 8) through which projects the poppet pin 230. Liquid can flow through this aperture 226 for refilling the pump chamber 80 during a step in the operation of the pump as explained in detail hereinafter. Air or other vapor can also flow in the reverse direction through the aperture 226 during venting of the pump chamber 80 to facilitate priming of the pump in a manner described in detail hereinafter in the Section entitled "Operation Of The Pump—Venting And Priming Of The Pump Chamber." The grooves 241 defined between the poppet ribs 234 function, along with the aperture 226, as flow channels for the filling liquid or the venting air.

It can be seen in FIG. 8 that a peripheral portion of the top of the spring 240 extends radially outwardly beyond the poppet pin ribs 234 by an amount sufficient to engage the sealing conduit 190. Specifically, in the inactive position of the pump illustrated in FIGS. 1 and 8, the cross wall 222 of the conduit 190 engaged by the outer periphery of the top of the spring 240. The sealing conduit 190 thus rests under the influence of gravity by its own weight on the outer periphery of the top of the spring 240.

The engagement of the poppet 150 and the sealing conduit 190 with the spring 240 may be characterized as defining a first extreme or end of relative axial movement in a lost motion arrangement or means between the poppet 150 and sealing conduit 190. The second extreme or end of the relative axial movement in the lost motion arrangement is defined as the orientation of the poppet 150 and sealing conduit 190 wherein the sealing conduit 190 contacts the concave valve member surface 180 of the poppet secondary valve means (FIG. 9). The sealing conduit upper cross wall 222 defines a peripheral contact surface 218 for being engaged by the concave valve member surface 180 at this second end of the relative movement range (FIG. 9). The circumstances under 30 which this relative movement occurs—from the first end of the movement range illustrated in FIG. 8 to the second end of the movement range illustrated in FIG. 9—is described in detail hereinafter.

The hollow cylindrical wall 202 of the sealing conduit 190 includes outwardly projecting, circumferentially spaced-apart guide ribs 250 for slidably contacting the inside of the pump chamber 80 to maintain axial alignment of the sealing conduit 190 within the chamber 80 and relative to the supply conduit 120.

The location of the ribs 234 (FIGS. 6 and 8) and grooves 241 (FIG. 6 only) on the poppet pin 230 is a preferred construction as opposed to locating the grooves in the inner cylindrical surface of the surrounding aperture 226 of the sealing conduit 190. This is because it is desired to mold the sealing conduit 190 from a thermoplastic material with a uniform configuration that will be subject to little or no deformation as a result of the molding process.

If the grooves 241 were instead molded in the inner cylindrical surface of the aperture 226 in the upper end of the sealing conduit 190, then the upper end of the sealing conduit 190 would have thick and thin regions radially inwardly of the sealing surface 218 of the sealing conduit 190. When the plastic material cooled after being injection molded, the thick sections could shrink more than the thin sections. This could pull or deform the sealing surface 218 out of the desired precise circular configuration, and this could lead to a defective seal when the sealing conduit 190 is engaged against the surface 180 on the underside of the poppet valve 150.

In contrast, when the ribs 234 and grooves 241 are molded in the poppet pin 230 as in the preferred illustrated embodiment, minor uneven shrinkage and any resulting minor deformation of the poppet pin 230 is not particularly critical since there is a circumferential clearance around the pin 230 and since the pin 230 does not have to perform any sealing function.

It can be seen that the spring 240 functions as a biasing means to normally bias the poppet 150, along with the engaged primary piston 82, to a fully raised position when the pump is in the inactive (i.e., unactuated) rest position. When the pump 20 is in the unactuated position, the spring 240 also supports the sealing conduit 190, and the bottom of the sealing conduit 190 is spaced above the open upper end 121 of the fixed supply conduit 120.

The bottom end of the sealing conduit 190 is adapted to slide downwardly along, and in sealing engagement with, the fixed supply conduit 120 in a telescoping relationship (see FIGS. 9–13). To this end, the bottom of the sealing conduit 190 includes an inwardly projecting annular seal 260 for engaging the exterior of the supply conduit 120 when the movable sealing conduit 190 moves downwardly under circumstances explained in detail hereinafter.

The above-described components of the pump 20 may be conveniently fabricated from thermoplastic materials. However, the spring 240 is preferably stainless steel. The novel design of the pump 20 is especially suitable for accommodating fabrication of the pump housing 48, including the fixed supply conduit 120, from polypropylene. Other internal components (e.g., the primary piston 82, poppet 150, and sealing conduit 190, or portions of these other components) may be fabricated from polyethylene to provide a better sealing action.

The novel design of the pump 20 permits the pump components to be easily assembled. Typically, the internal components of the pump 20 are assembled, and thereafter the suction tube 30 is attached to the bottom of the pump chamber 48 by conventional techniques.

With respect to assembly of the internal components, it is to be noted that the movable sealing conduit 190 may be readily disposed on the poppet pin 230 of the poppet 150. The assembled sealing conduit 190 and poppet 150 are then easily seated within the piston 82, and the three components are inserted together with the spring 240 into the pump chamber 80 of the pump housing 48.

Alternatively, the components lend themselves to automatic assembly. The pump housing 48 may be held in a jig or nest and then the spring 240 can be dropped into the housing pump chamber 80 inside the supply conduit 120. Next, the sealing conduit 190 is dropped over the spring 240. The poppet 150 is then dropped into the pump housing 48 with the poppet pin 230 projecting downwardly into the spring 240. Then the primary piston 82 is dropped on top of the poppet 150.

The collar 38 is seated on top of the pump housing 48 around the primary piston stem 86, and the cap 22 is mounted around the collar 38.

Attachment of the actuator head or button 90 to the upper end of the primary piston stem 86 completes the assembly of the pump 20 with the related actuator and container closure components. The entire assembly, including the pump 20, cap 22, button 90, and suction tube 30, may then be attached to the top of the container 26.

OPERATION OF THE PUMP

Dispensing From A Primed Pump

The operation of the pump 20 will next be described with reference to the operation sequence steps illustrated in FIGS. 8–13. The operation description assumes that the pump chamber 80 is initially primed substantially full of liquid and that the pump chamber 80 may also contain some residual air and/or liquid vapor. The actual priming of the pump will be described later. For purposes of clarity, the liquid per se is not illustrated in the Figures.

The initial, inactive, raised position of the pump 20 is shown in FIG. 8. The primary piston 82 is in the maximum elevated position and engages the lower portion of the inner cylindrical wall 72 of the collar 38. The collar 38 thus determines the maximum height of the primary piston 82 in the pump chamber 80.

The poppet 150 is biased upwardly by the spring 240 to occlude the primary piston discharge passage 98. The sealing conduit 190 is supported by the periphery of the upper end of the spring 240. The bottom end of the sealing conduit 190 is spaced above the top end 121 of the fixed supply conduit 120.

The pump 20 has been primed with liquid which fills the interior of the fixed supply conduit 120 as well as a substantial portion of the remaining volume in the pump chamber 80 below the primary piston 82 both inside and outside of the sealing conduit 190.

The pump 20 is actuated by applying a downward force on the actuator head or button 90 (FIG. 1) so as to begin to move the primary piston 82 downwardly in the pump chamber 80. The poppet 150 is also necessarily forced downwardly by the primary piston 82 with which it is engaged. The sealing conduit 190 continues to be supported by the spring 240 until the inwardly projecting annular seal 260 at the bottom end of the sealing conduit 190 engages the exterior of the top end 121 of the supply conduit 120 as illustrated in FIG. 9. At this point, there is sufficient frictional engagement between the sealing conduit 190 and the supply conduit 120 to retard further downward movement of the sealing conduit 190 under its own weight. Until this engagement occurs, the pump chamber 80 cannot, of course, be pressurized since the pump chamber is in communication with the interior of the container 26 through the supply conduit 120.

As illustrated in FIG. 9, the sealing conduit 190 thus remains stationary and engaged with the fixed supply conduit 120 while the primary piston 82 and poppet 150 continue moving downwardly together relative to the sealing conduit 190. The range of downward movement of the poppet 150 that is permitted by the lost motion arrangement between the poppet 150 and sealing conduit 190 is such that concave valve member surface 180 of the poppet 150 eventually seals against the peripheral contact surface 218 at the top of the sealing conduit 190.

Until this sealing engagement occurs at the top of the sealing conduit 190, any tendency of the downwardly moving primary piston 82 to pressurize the pump chamber 80 can result in a very small amount of the liquid and/or residual air (or vapor) being forced from the pump chamber 80 down the fixed supply conduit 120 and back into the container 26. After the sealing engagement occurs between the poppet 150 and the top of the sealing conduit 190, communication between the container 26 and the pump chamber 80 is interrupted, and the pump chamber 80 becomes increasingly pressurized with increasing downward movement of the primary piston 82.

It is to be noted that once the poppet 150 engages the top of the sealing conduit 190, any continued downward movement of the poppet 150 will necessarily effect downward movement of the sealing conduit 190 along the fixed supply conduit 120 with the sealing engagement being maintained between the poppet secondary valve means surface 180 and the sealing conduit peripheral contact surface 218.

Figure 10:
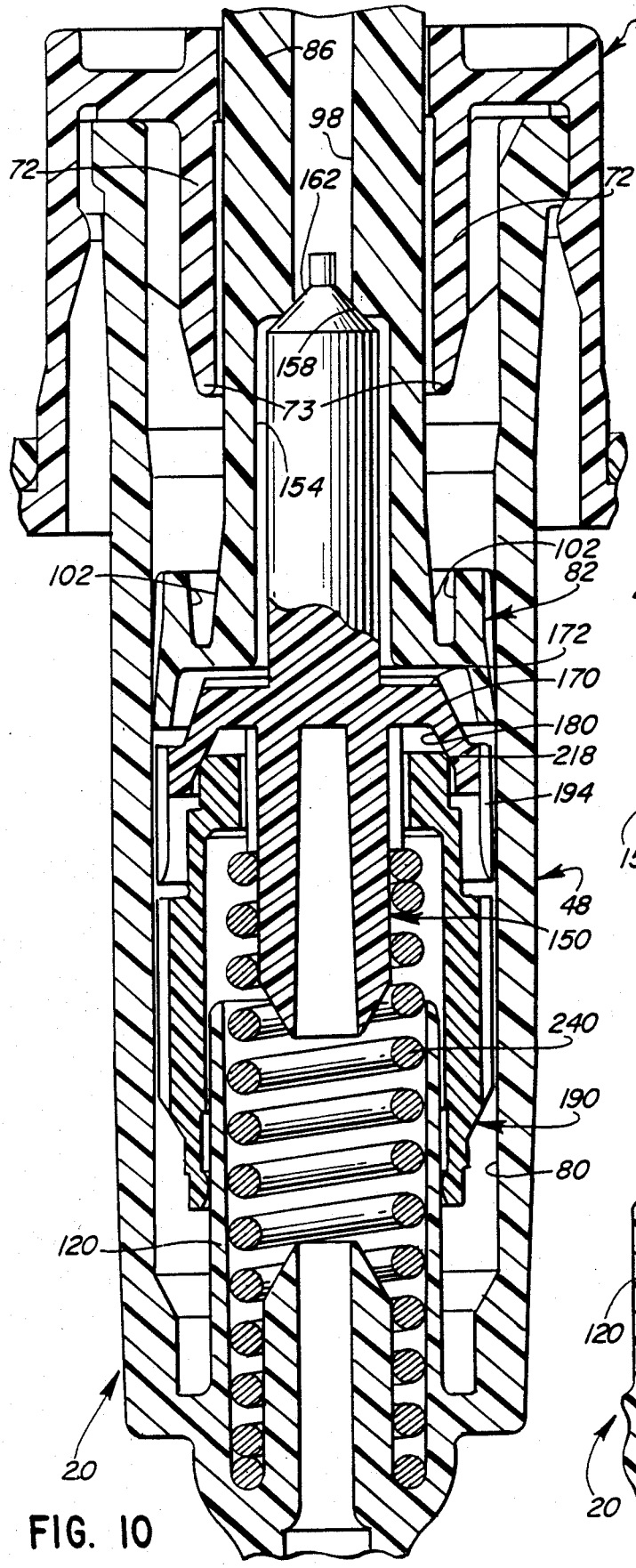

FIG. 10 illustrates the relationship of the pump components at a point of maximum pressure just before the liquid is first discharged upwardly through the pump. The elevation of the primary piston 82 in the chamber 80 at the point of maximum chamber pressure depends upon the strength of the spring 240 as well as upon the initial chamber liquid load conditions (i.e., the amount of liquid and/or residual air (or vapor) initially in the pump chamber 80).

At the point of maximum pressurization, the degree of compression of the liquid and entrapped residual air and/or vapor within the pump chamber 80 is such that the thrust acting downwardly on the poppet piston surface 172 exceeds the upward thrust of the spring 240, with the result that the poppet 150 moves downwardly at a greater velocity than the primary piston 82. This, in turn, causes the primary valve means sealing surface 162 to open the discharge passage 98, and to remain open as long as such differential pressure is maintained (see FIG. 11).

Figure 11:
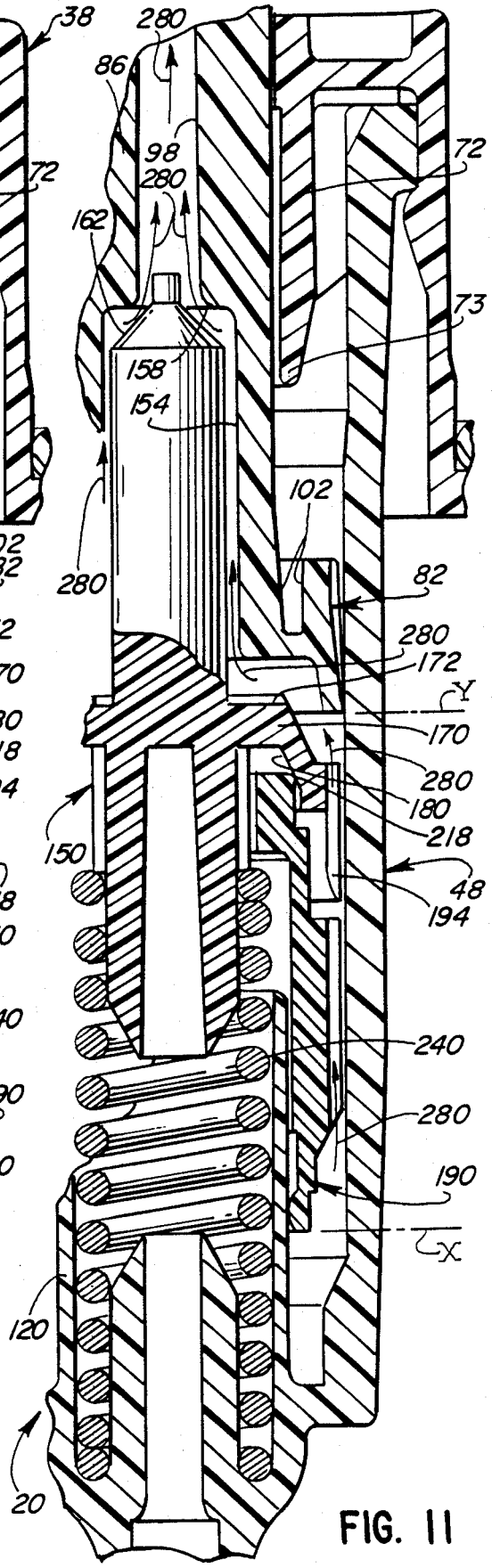

During the time that the discharge passage 98 is open, the liquid product is discharged through the passage 98 as illustrated by the flow arrows 280 in FIG. 11. The liquid is thus forced under pressure to the nozzle assembly where it is discharged from the orifice 92 as a finely atomized spray or mist.

Figure 11A:
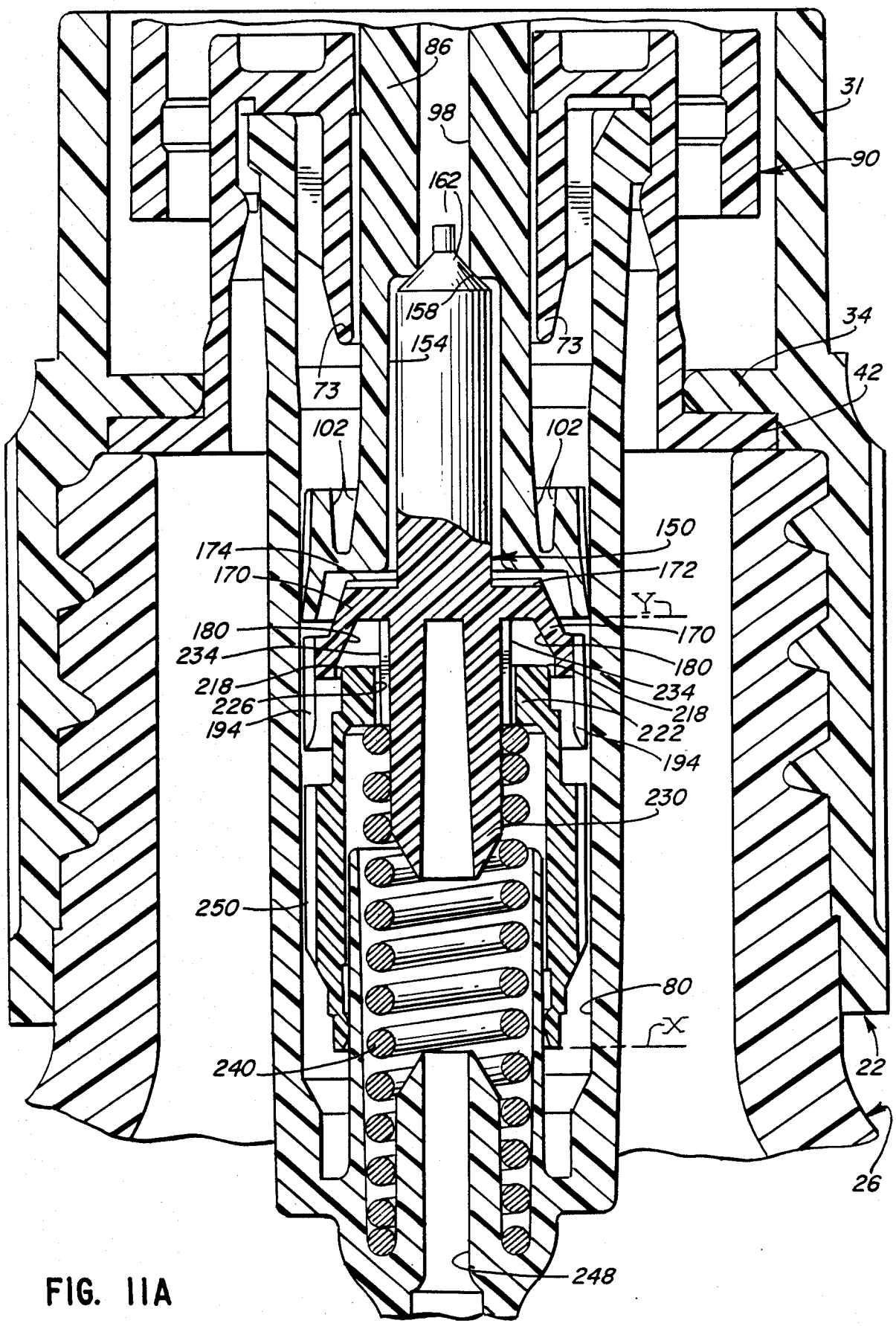

If the downward movement of a primary piston 82 is slowed or completely stopped at, for example, elevation Y as illustrated in FIG. 11, then the sealing conduit 190 will stop along the inlet conduit 120 at, for example, elevation X as illustrated in FIG. 11. The spring 240 will subsequently force the poppet 150 back upwardly against the primary piston 82 as illustrated in FIG. 11A to occlude the discharge passage 98 after a sufficient amount of the pressurized fluid has been discharged. That is, the discharge of the fluid from the pump is terminated whenever the pressure drops below the predetermined operating pressure (established by the spring 240 operating in conjunction with the other pump components). Since the liquid is thus always discharged at a predetermined pressure, proper atomization can be ensured by employing a suitable nozzle. The tendency of the pump to dribble from the spray orifice 92 is very substantially reduced or eliminated altogether.

When the poppet 150 moves upwardly toward the primary piston 82 to occlude further discharge from the pump (FIG. 11A), the sealing conduit 190 initially remains stationary owing to its frictional engagement with the supply conduit 120. Thus, the poppet 150 will separate from the top of the sealing conduit 190.

Eventually, as the poppet 150 moves upwardly far enough to seal against the discharge passage 98, the top of the spring 240 around the poppet pin 230 will engage the sealing conduit 190 (FIG. 11A). If the primary piston 82 has been maintained at the initially depressed elevation, say at elevation Y in FIGS. 11 and 11A, then the poppet 150 will reclose the discharge passage 98 at the same instant the top of the spring 240 again just engages the sealing conduit 190 which has remained at the elevation X. Thus, the upwardly moving poppet 150 separates from the sealing conduit 190 within the extent permitted by the spring in the lost motion arrangement. At this point, any residual pressure in the pump chamber 80 could force a small amount of the liquid (and/or entrapped air and vapor) into the region under the poppet 150 from which region the flow passes down through the sealing conduit 190, through the fixed supply conduit 120, and into the container 26.

If the primary piston 82 is permitted to rise (for example, above elevation Y in FIG. 11A), then the spring 240 will simultaneously urge the sealing conduit 190 and poppet 150 upwardly together in the spaced-apart relationship shown in FIG. 11A with the poppet 150 continuing to close off the discharge passage 98.

However, if the primary piston 82 is subsequently forced further downwardly in the pump chamber 80, the poppet 150 again seals against the top of the sealing conduit 190 so that additional downward movement of the primary piston 82 again begins to pressurize the pump chamber 80. If and when the maximum design pressure is again attained in the pump chamber 80, the poppet 150 is again forced away from the primary piston 82 to permit further discharge of the liquid from the pump.

It will be appreciated that the sealing conduit 190, owing to its frictional engagement with the fixed supply conduit 120 during operation of the pump, will remain in place on the supply conduit 120 during pre-discharge pressurization of the pump chamber 80 even if the pump 20 is inverted. Thus, if the container is inverted prior to spray discharge, pressure cannot be inadvertently vented to the container so long as the piston 82 is continuously depressed to seal the poppet 150 against the sealing conduit 190 while the pump chamber is being pressurized—even at very low pressures.

Figure 12:
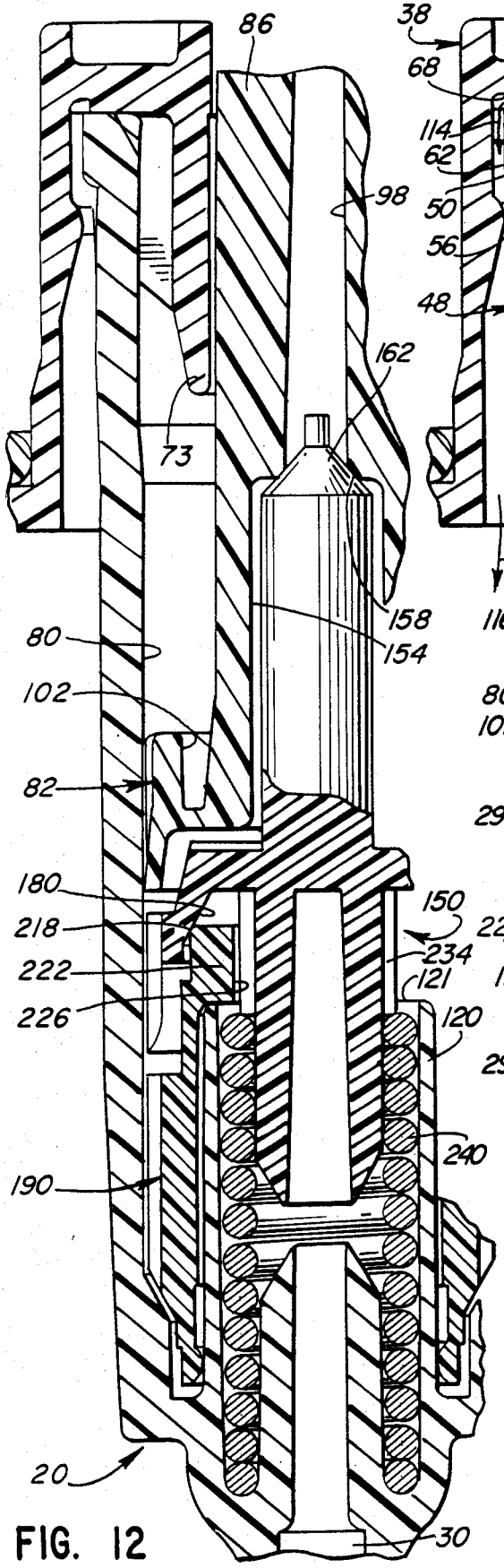

The downward stroke of the primary piston 82 is mechanically terminated at the maximum stroke length illustrated in FIG. 12. At the bottom of the stroke, the primary piston 82, with the poppet 150 seated therein and the sealing conduit 190 sealingly engaged with the underside of the poppet 150, has moved sufficiently downwardly in the pump chamber 80 so that the sealing conduit top cross wall 222 abuts the open top end 121 of the fixed supply conduit 120.

Of course, it will be appreciated that a sufficient amount of spray may have been generated long before the primary piston 82 would reach the bottom of the maximum permissible stroke illustrated in FIG. 12. In such a situation, the finger force on the top of the actuator button 90 would typically be released before the full stroke condition had been attained. In any case, release of the finger pressure from the actuator button 90, at the end of a full down stroke or at any intermediate stroke position, permits the spring 240 to return the pump 20 to the fully raised, inactive position.

Refilling Of The Pump

FIG. 13 illustrates the pump 20 just after the finger pressure on the actuator button 90 has been released and just after the primary piston 82 has begun moving upwardly in the pump chamber 80 in response to the biasing force of the spring 240 pushing the poppet 150 against the primary piston 82. As the poppet 150 moves upwardly, the sealing conduit 190 initially remains frictionally engaged with the fixed supply conduit 120 so that the poppet 150 separates from the top of the sealing conduit 190 to the extent permitted by the lost motion arrangement (i.e., until the sealing conduit 190 is engaged by the spring 240). Communication is thus established between the container 26 and the pump chamber 80.

As the upper end of the spring 240, sealing conduit 190, poppet 150, and piston 82 move upwardly together, the volume under the piston 82 continues to increase. This lowers the pressure in the chamber 80. As a result, the container liquid which is at substantially atmospheric pressure, flows up the suction tube 30 over the top of the sealing conduit 190, and into the pump chamber 80 to refill the chamber as indicated by the flow arrows 297 in FIG. 13. Liquid continues to flow from the container 26 into the pump chamber 80 until the primary piston 82 reaches the fully elevated position.

Near the end of the return stroke of the primary piston 82 to the fully elevated position, the bottom end of the sealing conduit 190 separates from the fixed supply conduit 120 (FIG. 8), and additional liquid fills the pump chamber 80 through that separation space.

In some prior art accumulative pump constructions which are capable of dispensing more than small amounts of liquid, refilling of the pump chamber typically is dependent upon a differential pressure-actuated construction, such as a flapper valve, or a ball valve, or the like. In accordance with the present invention, a non-differential pressure mechanism, which is entirely mechanically operated, is provided. This positive, mechanical opening of an entry passage into the pump chamber from the supply source assures proper and rapid refilling under all conditions and circumstances.

Venting Of The Container

Whenever liquid is drawn from the container 26 up the suction tube 30 into the pump 20, atmospheric pressure must be maintained over the remaining liquid in the container 26 so as to cause the liquid to flow into the pump 20. To this end, ambient atmosphere is permitted to flow into the container 26 whenever the primary piston 82 is located below the fully elevated rest position. As explained above in detail in the section entitled "Description Of The Components And Arrangement Of The Components," the diameter of the upper part of the primary piston stem 86 is smaller than the diameter of the lower part of the stem 86 so that ambient air can flow between the collar 38 and the piston stem 86 when the piston 82 is depressed. The ambient air then flows into the container 26 through the passageways in the collar 38 as previously described in detail with reference to FIG. 13. Since the top of the container interior is in communication with ambient atmosphere when the primary piston 82 is depressed below the fully elevated position, there will always be sufficient pressure in the top of the container 26 to force the liquid into the reduced pressure region of the pump chamber 80 whenever the primary piston 82 begins to return to the fully elevated position.

Venting And Priming Of The Pump Chamber

The pump 20 of the present invention has a novel and effective means for venting air from the pump chamber to aid in priming the pump chamber 80 when liquid is initially absent from the pump chamber 80. In particular, when the primary piston 82 is initially forced downwardly in the pump chamber 80 containing no liquid, the air and/or vapor in the chamber is compressed. However, owing to the large volume of the pump chamber 80 and to the highly compressible nature of the air and/or vapor, the pressure build-up on the top of the poppet piston surface 172 is not sufficient to overcome the force of the spring 240. The discharge passage 98 in the primary piston 82 thus remains closed.

However, when the finger force on the actuator button 90 is released at or near the bottom of the maximum stroke of the piston 82, the poppet 150 moves away from its sealing engagement with the top of the sealing conduit 190 (i.e., to the same spaced relationship as illustrated in FIG. 13). The pressurized air and/or vapor is then forced under the poppet 150 (opposite the direction of the liquid flow arrows 297 in FIG. 13), over the top of the sealing conduit 190, and down through the suction tube 30 into the top of the container 26 above the liquid therein.

This thus relieves or vents the pressure in the pump chamber so that the chamber will be able to subsequently receive the initial flow of liquid to be dispensed into the chamber as described in detail hereinafter.

The pump 20 is adapted to be primed without a venting aid which disrupts the sealing engagement as between the sealing conduit 190 and the fixed supply conduit 120 at the end of the stroke. It will be appreciated that this venting action is accomplished without the use of the prior art types of venting structures which have been built into the pump chambers for otherwise bypassing or interrupting the sealing engagement between pressurizing parts at the end of the pressurizing stroke. This use of the venting structure of the invention permits priming with partial (less than full) strokes (while pumps using prior art types of venting aids do not so permit), and also this use of the structure of the invention permits the use of the pump assembly for variable reduced outputs. Variable reduced outputs may be provided by changing the button skirt length to shorten the stroke length or by various other means to shorten the stroke length. Other such means include lengthening pin 230 or inner conduit 246 to shorten the stroke length. Venting will still be achieved effectively with short stroke pump assemblies, whereas it would not be if a typical prior art venting aid operable only at the end of the full stroke was used. Reduced output by simply pressing with reduced length strokes manually is possible with the structure of the pump disclosed herein.

With the pressure vented from the pump chamber 80, liquid will be able to enter the chamber. In particular, continued upward movement of the components of the pump 20 tends to draw in some liquid from the container 26. After a few full length strokes of the primary piston 82, a sufficient amount of air has been vented from the pump chamber 80 and a sufficient amount of liquid has been drawn into the pump chamber 80 so that subsequent strokes result in the discharge of a fine mist spray in the manner that has been previously described in detail.

In other prior art constructions, such as in the types of pumps disclosed in the previously discussed U.S. Pat. No. 4,025,046, an especially effective or tight seal must be employed circumferentially around the main piston where the main piston engages the interior cylindrical side surface of the pump chamber. The sealing forces must be relatively high because a relatively strong vacuum (reduced pressure) is drawn in the pump chamber as the main piston returns to the elevated (unactuated) position. The relatively great vacuum continues to be drawn as the main piston moves upwardly until the poppet sleeve slides off of the top of the suction conduit near the end of the pump return stroke. At this point, the relatively strong vacuum in the pump chamber permits the exterior ambient air pressure to fill the pump chamber and reduce the vacuum therein. Since the container liquid cannot be drawn into the pump chamber until near the end of the upward stroke of the pump when the poppet disengages from the sealing conduit, the very strong vacuum exists during most of the upwardly moving return stroke of the main piston. This strong vacuum creates a pressure differential across the seal between the main piston and the inside surface of the pump chamber, and this seal is susceptible to air in-leakage from outside of the pump.

In practice, commercial pumps fabricated in accordance with the teachings of the U.S. Pat. No. 4,025,046, typically include a special upper seal configuration which seals the main piston tightly against the inside surface of the pump chamber and which, necessarily, imposes a greater friction load on the pump actuator. Thus, the spring within the pump must be strong enough to return the pump actuator to the fully raised position in opposition to the great frictional force between the main piston and the pump chamber wall as well as in opposition to the pressure differential being created as the piston moves upwardly. Since the spring must necessarily be sized to provide a sufficient upward force, the force required to press the actuator down against the force of the spring is also necessarily greater. In some situations, for instance where the pump is to be actuated by a young child or an elderly person having reduced finger strength, such a pump may be difficult to operate effectively.

In contrast with pumps fabricated in accordance with the above-discussed U.S. Pat. No. 4,025,046, pumps according to the present invention may use a relatively weaker spring and may therefore be more readily operated by young children or elderly persons. A weaker spring may be used in the pump of the present invention because the sealing force between the primary piston 82 and inner surface of the pump chamber 80 may be considerably reduced as a result of a considerably reduced amount of vacuum (reduced pressure) that is created inside the pump chamber 80 as the primary piston 82 moves upwardly on the return stroke.

The pump of the present invention operates effectively by drawing less vacuum within the pump chamber 80 because the poppet 150 moves upwardly away from its sealing engagement with the top of the sealing conduit 190 when the finger force on the actuator button 90 is released. Thus, the liquid from the container flows up the suction tube 30, over the top of the sealing conduit 190, and into the pump chamber 80 to refill the chamber almost immediately after the force is removed from the button 90 which permits the primary piston 82 to begin to move upwardly to the fully elevated position. Thus, if the force is removed from the actuator button 90 when the primary piston 82 is at or near the bottom of the downstroke, the refilling of the pump chamber 80 begins when the primary piston 82 is still substantially at the lowermost position within the pump chamber.

As the primary piston 82 rises in the pump chamber 80, the incoming liquid is being forced into the pump chamber 80 underneath the primary piston 82 at substantially atmospheric pressure. Thus, the vacuum (reduced pressure) that is drawn within the pump chamber 80 beneath the primary piston 82 remains relatively low. Since the vacuum beneath the primary piston 82 remains relatively low, the differential between the pressure in the pump chamber 80 beneath the primary piston 82 and the exterior ambient atmospheric pressure above the primary piston 82 remains relatively low. Since there is a relatively low pressure differential across the primary piston 82, the sealing forces between the primary piston 82 and the wall of the pump chamber 80 can be relatively low. Thus, the force of frictional engagement between the primary piston 82 and the wall of the pump chamber 80 can be relatively low. Since the frictional engagement force is relatively low, the force of the spring 240 may also be relatively low. The spring need only overcome the relatively low frictional force and the relatively low pressure differential force resulting from the relatively low vacuum in the pump chamber. The use of a relatively weak spring 240 permits the pump to be more readily actuated by a child or elderly person.

It will be readily observed from the foregoing detailed description of the invention and from the illustrated embodiment thereof that numerous variations and modifications may be effected without departing from the true spirit and scope of the novel concepts or principles of this invention.

What is claimed is:

1. A finger-operated pump comprising:

a pump chamber;

a supply conduit communicating with said pump chamber;

a movable sealing conduit for movement between a raised, unactuated position and a range of lowered, actuated positions in which said sealing conduit slidably and sealingly engages said supply conduit in a telescoping relationship;

a primary piston operably disposed in said chamber for movement between a raised, unactuated rest position and a range of lowered, actuated positions, said primary piston defining a discharge passage out of said pump chamber;

a poppet having a primary valve means for occluding flow through said discharge passage and having a secondary valve means for occluding flow through said sealing conduit, said poppet being movable a limited amount relative to said sealing conduit when said sealing conduit is engaged with said supply conduit; and spring means for (1) biasing said poppet primary valve means against said primary piston to urge said primary piston toward its said raised, unactuated, rest position and (2) engaging both said poppet and sealing conduit after actuation of said pump to return said sealing conduit to its said raised, unactuated rest position and maintain said poppet primary valve means biased against said primary piston in its said raised, unactuated position.

2. The finger-operated pump in accordance with claim 1 in which said spring means includes only one helical compression spring.

3. The finger-operated pump in accordance with claim 1 in which said pump includes lost motion means for permitting a limited degree of said relative movement between said poppet and sealing conduit between first and second extremes of said relative movement, said lost motion means including said spring means engagable with both said poppet and sealing conduit after actuation of said pump to return said sealing conduit to its said raised, unactuated rest position and maintain said poppet primary valve means biased against said primary piston in its said raised, unactuated position.

4. The finger-operated pump in accordance with claim 3 in which said spring means includes only one spring operatively disposed to engage said poppet and not said sealing conduit when said poppet and sealing conduit are at said second extreme.

5. The finger-operated pump in accordance with claim 1 in which said poppet includes (1) an upper portion defining said primary valve means, (2) a lower portion defining said secondary valve means, and (3) an upwardly facing piston surface for being pressurized by said liquid in said pump chamber so as to move said primary valve means in opposition to the force of said spring means to open said discharge passage.

6. The finger-operated pump in accordance with claim 5 in which said poppet has a concave valve member surface defining said secondary valve means;

said sealing conduit has an upper end with a peripheral contact surface for being engaged by said concave valve member surface to occlude flow therethrough; and said pump has a lost motion means that includes (1) said poppet concave valve member surface and (2) said sealing conduit peripheral contact surface which, when engaged to occlude flow, also function as part of said lost motion means to limit said amount of relative movement.

7. The finger-operated pump in accordance with claim 6 in which said spring means includes a helical compression spring having a lower end maintained at a fixed elevation relative to said pump chamber and a movable upper end at least partly engaged with said poppet, said spring upper end including at least a portion extending radially beyond at least a portion of said poppet to engage said sealing conduit.

8. The finger-operated pump in accordance with claim 7 in which said limited amount of relative movement between said poppet and said sealing conduit is defined by the difference between (1) the greater axial distance between the line of contact on said poppet concave valve member surface with said sealing conduit peripheral contact surface and the line of contact of said spring with said sealing conduit and (2) the lesser axial distance between the line of contact on said sealing conduit peripheral contact surface with said poppet concave valve member surface and the line of contact of said spring with said sealing conduit.

9. The finger-operated pump in accordance with claim 1 in which said spring means includes a compression spring having a lower end maintained at a fixed elevation relative to said pump chamber and a movable upper end at least partly engaged with said poppet, said spring upper end including at least a portion extending radially beyond at least a portion of said poppet to engage said sealing conduit.

10. The finger-operated pump in accordance with claim 9 in which said spring is helical; and said poppet includes at least one rib extending radially outwardly for being at least partly engaged by said spring.

11. The finger-operated pump in accordance with claim 1 in which said sealing conduit has an upper end defining a generally smooth circular opening; and said poppet has a downwardly projecting pin disposed in said sealing conduit opening, said poppet further having a plurality of circumferentially spaced-apart ribs extending radially outwardly and defining a plurality of grooves for accommodating fluid flow past said poppet pin.

12. The finger-operated pump in accordance with claim 1 in which said supply conduit includes a fixed cylindrical tube that projects upwardly inside said pump chamber and that terminates in an open upper end.

13. The finger-operated pump in accordance with claim 12 in which said movable sealing conduit includes a generally cylindrical hollow wall.

14. The finger-operated pump in accordance with claim 13 in which said generally cylindrical hollow wall of said sealing conduit is adapted to engage the exterior of said supply conduit cylindrical tube.

15. The finger-operated pump in accordance with claim 14 in which said sealing conduit hollow wall includes an inwardly projecting annular seal for engaging the exterior of said supply conduit cylindrical tube.

16. The finger-operated pump in accordance with claim 15 in which said spring means normally biases said poppet, along with the engaged primary piston and sealing conduit, to a raised position when said pump is unactuated wherein said sealing conduit annular seal is spaced above said open upper end of said supply conduit cylindrical tube.

17. The finger-operated pump in accordance with claim 13 in which said sealing conduit has an upper cross wall defining therein an aperture through which liquid can flow for refilling said pump chamber as said primary piston and poppet move upwardly in said pump chamber.

18. The finger-operated pump in accordance with claim 17 in which said spring means includes a helical spring that (1) has a lower end disposed in said supply conduit cylindrical tube, (2) extends upwardly out of said supply conduit cylindrical tube, and (3) has an upper end projecting inside said sealing conduit cylindrical hollow wall; and said poppet includes a downwardly projecting pin passing through said sealing conduit cross wall aperture and inside an upper portion of said helical spring to maintain axial alignment of said spring.

19. The finger-operated pump in accordance with claim 13 in which said sealing conduit hollow cylindrical wall includes outwardly projecting, circumferentially spaced-apart guide ribs for slidably contacting the inside of said pump chamber and maintaining axial alignment of said sealing conduit.

20. The finger-operated pump in accordance with claim 1 in which, during engagement between the movable sealing conduit and the supply conduit on a downstroke, the movable sealing conduit remains in continuous, unbroken sealing engagement with said supply conduit throughout the length of the downstroke.

21. A finger-operated pump comprising:

a pump chamber;

a supply conduit communicating with said pump chamber;

a primary piston means slidable in said pump chamber for defining a discharge passage out of said pump chamber and for forcing liquid out of said pump chamber via said discharge passage;

a movable sealing conduit for slidably and sealingly engaging said supply conduit;

a poppet having (1) a primary valve means for being moved against said primary piston means to occlude said discharge passage, (2) a piston surface for being pressurized to move said poppet away from said primary piston means so as to space said primary valve means away from said discharge passage to permit flow therethrough, and (3) a secondary valve means for being moved against said sealing conduit and occluding flow therethrough from said pump chamber;

biasing means for biasing said poppet against said primary piston means to seal said discharge passage with said primary valve means; and lost motion means for defining a lost motion arrangement between said poppet and said sealing conduit to permit a limited degree of relative movement between said poppet and sealing conduit between first and second extremes of said relative movement, said lost motion means including a portion of said biasing means being located to simultaneously engage said poppet and said sealing conduit at said first extreme of said relative movement whereby, at said first extreme of said relative movement, flow through said sealing conduit is permitted by said secondary valve means, and at said second extreme of said relative movement, flow through said sealing conduit is prevented by said secondary valve means.

22. The finger-operated pump in accordance with claim 21 in which said supply conduit projects into said pump chamber and has an upper end defining an outlet opening;

said poppet has a flange with an upwardly facing annular surface defining said piston surface;

said poppet flange has a downwardly facing concave valve member surface defining said secondary valve means; and said movable sealing conduit includes (1) a generally cylindrical hollow wall that is adapted for fitting telescopically over said supply conduit upper end and for slidably and sealingly engaging said supply conduit, and (2) an upper end peripheral contact surface for being sealingly engaged by said poppet concave valve member surface.

23. A finger-operated pump for conveying liquid from a suction tube extending into a container holding liquid, said pump comprising:

supply conduit means for defining a liquid flow passage, said supply conduit means having a lower inlet end opening for communicating with the top end of said suction tube and having an upper end outlet opening from which said liquid is discharged;

pump chamber means for defining a pressurizable chamber around said supply conduit means upper end outlet opening to receive said discharging liquid;

primary piston means sealingly and slidably disposed in said pump chamber means and reciprocable therein for pressurizing said liquid in said pump chamber means when said primary piston is moved toward said supply conduit means;

discharge passage means for defining a liquid discharge passage through said primary piston means and out of said pump chamber means;

movable sealing conduit means for being sealingly and slidably engaged with said supply conduit means during at least a portion of the movement of said primary piston means toward said supply conduit means and for defining an upper end opening from which said liquid is discharged;

a poppet comprising (1) a primary valve means for moving with said poppet between (a) a closed position against said primary piston means to occlude flow through said discharge passage means in said primary piston means, and (b) an open position spaced from said primary piston means to permit flow through said discharge passage means in said primary piston means; and (2) secondary valve means movable with said primary valve means for engaging said sealing conduit means upper end to prevent back flow through said sealing conduit means upper end opening when said pump chamber means is being increasingly pressurized;

biasing means for biasing said poppet to locate said primary valve means at said closed position against said primary piston means; and lost motion means for defining a lost motion arrangement between said secondary valve means and said movable sealing conduit means to permit a limited degree of relative movement of said secondary valve means and said sealing conduit means between (1) a full open first position permitting flow through said sealing conduit means upper end opening, and (2) a full closed second position occluding back flow through said sealing conduit means upper end opening, said lost motion means including a portion of said biasing means being located to simultaneously engage a portion of said secondary valve means and said sealing conduit when said secondary valve means and sealing conduit are at said full open position.

24. The finger-operated pump in accordance with claim 23 in which said poppet further defines an upwardly facing piston surface for being pressurized to move said poppet downwardly away from said primary piston means so as to space said primary valve means away from said discharge passage to permit flow therethrough when a predetermined pressure exists in said pump chamber.

25. The finger-operated pump in accordance with claim 23 in which, during engagement between the movable sealing conduit means and the supply conduit means on a downstroke, the movable sealing conduit means remains in continuous, unbroken sealing engagement with said supply conduit means throughout the length of the downstroke.

26. A finger-operated pump comprising:

a pump chamber;

a supply conduit communicating with said pump chamber;

a movable sealing conduit for movement between a raised, unactuated position and a range of lowered, actuated positions in which said sealing conduit slidably and sealingly engages said supply conduit in a telescoping relationship;

a primary piston operably disposed in said chamber for movement between a raised, unactuated rest position and a range of lowered, actuated positions, said primary piston defining a discharge passage out of said pump chamber;

a poppet having a primary valve means for occluding flow through said discharge passage and having a secondary valve means for occluding flow through said sealing conduit;

biasing means for biasing said poppet primary valve means against said primary piston to urge said primary piston toward its said raised, unactuated, rest position; and means for permitting a limited degree of relative movement between said poppet and sealing conduit, said means including a portion of said biasing means being located to engage both said poppet and said sealing conduit after actuation of said pump to return said sealing conduit to its said raised, unactuated rest position and maintain said poppet primary valve means biased against said primary piston in its said raised, unactuated position.

27. The finger-operated pump in accordance with claim 26 in which said means for permitting a limited degree of relative movement includes lost motion means for limiting said poppet and sealing conduit relative movement between first and second extremes of said relative movement.

28. The finger-operated pump in accordance with claim 27 in which said biasing means is operatively disposed to engage said poppet and not said sealing conduit when said poppet and sealing conduit are at said second extreme.

29. The finger-operated pump in accordance with claim 26 in which said poppet includes (1) an upper portion defining said primary valve means, (2) a lower portion defining said secondary valve means, and (3) an upwardly facing piston surface for being pressurized by said liquid in said pump chamber so as to move said primary valve means in opposition to the force of said biasing means to open said discharge passage.

30. The finger-operated pump in accordance with claim 29 in which said poppet has a concave valve member surface defining said secondary valve means;

said sealing conduit has an upper end with a peripheral contact surface for being engaged by said concave valve member surface to occlude flow therethrough; and said pump includes a lost motion means that includes said poppet concave valve member surface and said sealing conduit peripheral contact surface which, when engaged to occlude flow, also function as part of said lost motion means to limit said relative movement.

31. The finger-operated pump in accordance with claim 30 in which said biasing means includes a helical compression spring having a lower end maintained at a fixed elevation relative to said pump chamber and a movable upper end at least partly engaged with said poppet; and said lost motion means includes at least a portion of said spring upper end extending radially beyond at least a portion of said poppet to engage said sealing conduit.

32. The finger-operated pump in accordance with claim 31 in which said limited degree of relative movement between said poppet and said sealing conduit is defined by the difference between (1) the greater axial distance between the line of contact on said poppet concave valve member surface with said sealing conduit peripheral contact surface and the line of contact of said spring with said sealing conduit and (2) the lesser axial distance between the line of contact on said sealing conduit peripheral contact surface with said poppet concave valve member surface and the line of contact of said spring with said sealing conduit.

33. The finger-operated pump in accordance with claim 26 in which said biasing means includes a compression spring having a lower end maintained at a fixed elevation relative to said pump chamber and a movable upper end at least partly engaged with said poppet; and said pump includes a lost motion means that includes at least a portion of said spring upper end extending radially beyond at least a portion of said poppet to engage said sealing conduit when said sealing conduit and poppet are at a first extreme of said relative movement and to be disengaged from said sealing conduit when said sealing conduit and poppet are at a second extreme of said relative movement.

34. The finger-operated pump in accordance with claim 33 in which said spring is helical; and said poppet includes at least one rib extending radially outwardly for being at least partly engaged by said spring.

35. The finger-operated pump in accordance with claim 26 in which said sealing conduit has an upper end defining a generally smooth circular opening; and said poppet has a downwardly projecting pin disposed in said sealing conduit opening, said poppet further having a plurality of circumferentially spaced-apart ribs extending radially outwardly and defining a plurality of grooves for accommodating fluid flow past said poppet pin.

36. A finger-operated pump comprising:

a pump chamber;

a supply conduit communicating with said pump chamber;

a movable sealing conduit for slidably and sealingly engaging said supply conduit in a telescoping relationship;

a primary piston operably disposed in said chamber and defining a discharge passage out of said pump chamber;

a poppet having a primary valve means for occluding flow through said discharge passage and having a secondary valve means for occluding flow through said sealing conduit; and lost motion means for permitting a limited degree of relative movement between said poppet and sealing conduit between first and second extremes of said relative movement, said lost motion means including spring means for (1) biasing said poppet primary valve means against said primary piston and (2) engaging said poppet and sealing conduit at least when said poppet and sealing conduit are at said first extreme, said spring means including only one spring operatively disposed to engage said poppet and not said sealing conduit when said poppet and sealing conduit are at said second extreme.

37. A finger-operated pump comprising:

a pump chamber;

a supply conduit communicating with said pump chamber;

a movable sealing conduit for slidably and sealingly engaging said supply conduit in a telescoping relationship;

a primary piston operably disposed in said chamber and defining a discharge passage out of said pump chamber;

a poppet having a primary valve means for occluding flow through said discharge passage and having a secondary valve means for occluding flow through said sealing conduit; and lost motion means for permitting a limited degree of relative movement between said poppet and sealing conduit between first and second extremes of said relative movement, said lost motion means including spring means for (1) biasing said poppet primary valve means against said primary piston and (2) engaging said poppet and sealing conduit at least when said poppet and sealing conduit are at said first extreme, said poppet including (1) an upper portion defining said primary valve means, (2) a lower portion defining said secondary valve means, and (3) an upwardly facing piston surface for being pressurized by said liquid in said pump chamber so as to move said primary valve means in opposition to the force of said spring means to open said discharge passage.

38. The finger-operated pump in accordance with claim 37 in which said poppet has a concave valve member surface defining said secondary valve means;

said sealing conduit has an upper end with a peripheral contact surface for being engaged by said concave valve member surface to occlude flow therethrough; and said lost motion means further includes (1) said poppet concave valve member surface and (2) said sealing conduit peripheral contact surface which, when engaged to occlude flow, also function as part of said lost motion means to limit said relative movement at said second extreme of said relative movement.

39. The finger-operated pump in accordance with claim 38 in which said spring means includes a helical compression spring having a lower end maintained at a fixed elevation relative to said pump chamber and a movable upper end at least partly engaged with said poppet, said spring upper end including at least a portion extending radially beyond at least a portion of said poppet to engage said sealing conduit when said sealing conduit and poppet are at said first extreme of said relative movement.

40. The finger-operated pump in accordance with claim 39 in which said limited degree of relative movement between said poppet and said sealing conduit is defined by the difference between (1) the greater axial distance between the line of contact on said poppet concave valve member surface with said sealing conduit peripheral contact surface and the line of contact of said spring with said sealing conduit and (2) the lesser axial distance between the line of contact on said sealing conduit peripheral contact surface with said poppet concave valve member surface and the line of contact of said spring with said sealing conduit.

41. A finger-operated pump comprising:

a pump chamber;

a supply conduit communicating with said pump chamber;

a movable sealing conduit for slidably and sealingly engaging said supply conduit in a telescoping relationship;

a primary piston operably disposed in said chamber and defining a discharge passage out of said pump chamber;

a poppet having a primary valve means for occluding flow through said discharge passage and having a secondary valve means for occluding flow through said sealing conduit; and lost motion means for permitting a limited degree of relative movement between said poppet and sealing conduit between first and second extremes of said relative movement, said lost motion means including spring means for (1) biasing said poppet primary valve means against said primary piston and (2) engaging said poppet and sealing conduit at least when said poppet and sealing conduit are at said first extreme, said spring means including a compression spring having a lower end maintained at a fixed elevation relative to said pump chamber and a movable upper end at least partly engaged with said poppet, said spring upper end including at least a portion extending radially beyond at least a portion of said poppet to engage said sealing conduit when said sealing conduit and poppet are at said first extreme of said relative movement.

42. The finger-operated pump in accordance with claim 41 in which said spring is helical; and said poppet includes at least one rib extending radially outwardly for being at least partly engaged by said spring.

43. A finger-operated pump comprising:

a pump chamber;

a supply conduit communicating with said pump chamber;

a movable sealing conduit for slidably and sealingly engaging said supply conduit in a telescoping relationship, said sealing conduit having an upper end defining a generally smooth circular opening;

a primary piston operably disposed in said chamber and defining a discharge passage out of said pump chamber;

a poppet having a primary valve means for occluding flow through said discharge passage and having a secondary valve means for occluding flow through said sealing conduit, said poppet having a downwardly projecting pin disposed in said sealing conduit opening, said poppet further having a plurality of circumferentially spaced-apart ribs extending radially outwardly and defining a plurality of grooves for accommodating fluid flow past said poppet pin; and lost motion means for permitting a limited degree of relative movement between said poppet and sealing conduit between first and second extremes of said relative movement, said lost motion means including spring means for (1) biasing said poppet primary valve means against said primary piston and (2) engaging said poppet and sealing conduit at least when said poppet and sealing conduit are at said first extreme.

44. A finger-operated pump comprising:

a pump chamber;

a supply conduit communicating with said pump chamber, said supply conduit including a fixed cylindrical tube that projects upwardly inside said pump chamber and that terminates in an open upper end;

a movable sealing conduit for slidably and sealingly engaging said supply conduit in a telescoping relationship, said movable sealing conduit including a generally cylindrical hollow wall adapted to engage the exterior of said supply conduit cylindrical tube, said sealing conduit hollow wall including an inwardly projecting annular seal for engaging the exterior of said supply conduit cylindrical tube;

a primary piston operably disposed in said chamber and defining a discharge passage out of said pump chamber;

a poppet having a primary valve means for occluding flow through said discharge passage and having a secondary valve means for occluding flow through said sealing conduit; and lost motion means for permitting a limited degree of relative movement between said poppet and sealing conduit between first and second extremes of said relative movement, said lost motion means including spring means for (1) biasing said poppet primary valve means against said primary piston and (2) engaging said poppet and sealing conduit at least when said poppet and sealing conduit are at said first extreme.

45. The finger-operated pump in accordance with claim 44 in which said spring means normally biases said poppet, along with the engaged primary piston and sealing conduit, to a raised position when said pump is unactuated wherein said sealing conduit annular seal is spaced above said open upper end of said supply conduit cylindrical tube.

46. A finger-operated pump comprising:

a pump chamber;

a supply conduit communicating with said pump chamber, said supply conduit including a fixed cylindrical tube that projects upwardly inside said pump chamber and that terminates in an open upper end;

a movable sealing conduit for slidably and sealingly engaging said supply conduit in a telescoping relationship, said movable sealing conduit including a generally cylindrical hollow wall;

a primary piston operably disposed in said chamber and defining a discharge passage out of said pump chamber;

a poppet having a primary valve means for occluding flow through said discharge passage and having a secondary valve means for occluding flow through said sealing conduit; and lost motion means for permitting a limited degree of relative movement between said poppet and sealing conduit between first and second extremes of said relative movement, said lost motion means including spring means for (1) biasing said poppet primary valve means against said primary piston and (2) engaging said poppet and sealing conduit at least when said poppet and sealing conduit are at said first extreme, said sealing conduit having an upper cross wall defining therein an aperture through which liquid can flow for refilling said pump chamber as said primary piston and poppet move upwardly in said pump chamber.

47. The finger-operated pump in accordance with claim 46 in which said spring means includes a helical spring that (1) has a lower end disposed in said supply conduit cylindrical tube, (2) extends upwardly out of said supply conduit cylindrical tube, and (3) has an upper end projecting inside said sealing conduit cylindrical hollow wall; and said poppet includes a downwardly projecting pin passing through said sealing conduit cross wall aperture and inside an upper portion of said helical spring to maintain axial alignment of said spring.

48. A finger-operated pump comprising:

a pump chamber;

a supply conduit communicating with said pump chamber, said supply conduit including a fixed cylindrical tube that projects upwardly inside said pump chamber and that terminates in an open upper end;

a movable sealing conduit for slidably and sealingly engaging said supply conduit in a telescoping relationship, said movable sealing conduit including a generally cylindrical hollow wall having outwardly projecting, circumferentially spaced-apart guide ribs for slidably contacting the inside of said pump chamber and maintaining axial alignment of said sealing conduit;

a primary piston operably disposed in said chamber and defining a discharge passage out of said pump chamber;

a poppet having a primary valve means for occluding flow through said discharge passage and having a secondary valve means for occluding flow through said sealing conduit; and lost motion means for permitting a limited degree of relative movement between said poppet and sealing conduit between first and second extremes of said relative movement, said lost motion means including spring means for (1) biasing said poppet primary valve means against said primary piston and (2) engaging said poppet and sealing conduit at least when said poppet and sealing conduit are at said first extreme.

49. A finger-operated pump comprising:

a pump chamber;

a supply conduit communicating with said pump chamber;

a movable sealing conduit for slidably and sealingly engaging said supply conduit in a telescoping relationship;

a primary piston operably disposed in said chamber and defining a discharge passage out of said pump chamber;

a poppet having a primary valve means for occluding flow through said discharge passage and having a secondary valve means for occluding flow through said sealing conduit;

biasing means for biasing said poppet primary valve means against said primary piston; and lost motion means for permitting a limited degree of relative movement between said poppet and sealing conduit between first and second extremes of said relative movement, said lost motion means including a portion of said biasing means being located to engage said poppet and said sealing conduit at said first extreme of said relative movement, said biasing means being operatively disposed to engage said poppet and not said sealing conduit when said poppet and sealing conduit are at said second extreme.

50. A finger-operated pump comprising:

a pump chamber;

a supply conduit communicating with said pump chamber;

a movable sealing conduit for slidably and sealingly engaging said supply conduit in a telescoping relationship;

a primary piston operably disposed in said chamber and defining a discharge passage out of said pump chamber;

a poppet having a primary valve means for occluding flow through said discharge passage and having a secondary valve means for occluding flow through said sealing conduit;

biasing means for biasing said poppet primary valve means against said primary piston; and lost motion means for permitting a limited degree of relative movement between said poppet and sealing conduit between first and second extremes of said relative movement, said lost motion means including a portion of said biasing means being located to engage said poppet and said sealing conduit at said first extreme of said relative movement, said poppet including (1) an upper portion defining said primary valve means, (2) a lower portion defining said secondary valve means, and (3) an upwardly facing piston surface for being pressurized by said liquid in said pump chamber so as to move said primary valve means in opposition to the force of said biasing means to open said discharge passage.

51. The finger-operated pump in accordance with claim 50 in which said poppet has a concave valve member surface defining said secondary valve means;

said sealing conduit has an upper end with a peripheral contact surface for being engaged by said concave valve member surface to occlude flow therethrough; and said poppet concave valve member surface and said sealing conduit peripheral contact surface, when engaged to occlude flow, also function as part of said lost motion means to limit said relative movement at said second extreme of said relative movement.

52. The finger-operated pump in accordance with claim 51 in which said biasing means includes a helical compression spring having a lower end maintained at a fixed elevation relative to said pump chamber and a movable upper end at least partly engaged with said poppet; and said lost motion means includes at least a portion of said spring upper end extending radially beyond at least a portion of said poppet to engage said sealing conduit when said sealing conduit and poppet are at said first extreme of said relative movement.

53. The finger-operated pump in accordance with claim 52 in which said limited degree of relative movement between said poppet and said sealing conduit is defined by the difference between (1) the greater axial distance between the line of contact on said poppet concave valve member surface with said sealing conduit peripheral contact surface and the line of contact of said spring with said sealing conduit and (2) the lesser axial distance between the line of contact on said sealing conduit peripheral contact surface with said poppet concave valve member surface and the line of contact of said spring with said sealing conduit.

54. A finger-operated pump comprising:

a pump chamber;

a supply conduit communicating with said pump chamber;

a movable sealing conduit for slidably and sealingly engaging said supply conduit in a telescoping relationship;

a primary piston operably disposed in said chamber and defining a discharge passage out of said pump chamber;

a poppet having a primary valve means for occluding flow through said discharge passage and having a secondary valve means for occluding flow through said sealing conduit;

biasing means for biasing said poppet primary valve means against said primary piston, said biasing means including a compression spring having a lower end maintained at a fixed elevation relative to said pump chamber and a movable upper end at least partly engaged with said poppet; and lost motion means for permitting a limited degree of relative movement between said poppet and sealing conduit between first and second extremes of said relative movement, said lost motion means including a portion of said biasing means being located to engage said poppet and said sealing conduit at said first extreme of said relative movement, said lost motion means including at least a portion of said compression spring upper end extending radially beyond at least a portion of said poppet to engage said sealing conduit when said sealing conduit and poppet are at said first extreme of said relative movement and to be disengaged from said sealing conduit when said sealing conduit and poppet are at said second extreme of said relative movement.

55. The finger-operated pump in accordance with claim 54 in which said spring is helical; and said poppet includes at least one rib extending radially outwardly for being at least partly engaged by said spring.

56. A finger-operated pump comprising:

a pump chamber;

a supply conduit communicating with said pump chamber;

a movable sealing conduit for slidably and sealingly engaging said supply conduit in a telescoping relationship, said sealing conduit having an upper end defining a generally smooth circular opening;

a primary piston operably disposed in said chamber and defining a discharge passage out of said pump chamber;

a poppet having a primary valve means for occluding flow through said discharge passage and having a secondary valve means for occluding flow through said sealing conduit, said poppet having a downwardly projecting pin disposed in said sealing conduit opening, said poppet further having a plurality of circumferentially spaced-apart ribs extending radially outwardly and defining a plurality of grooves for accommodating fluid flow past said poppet pin;

biasing means for biasing said poppet primary valve means against said primary piston; and lost motion means for permitting a limited degree of relative movement between said poppet and sealing conduit between first and second extremes of said relative movement, said lost motion means including a portion of said biasing means being located to engage said poppet and said sealing conduit at said first extreme of said relative movement.

* * * * *